US009791161B2

(12) United States Patent
Fujishiro et al.

(10) Patent No.: US 9,791,161 B2
(45) Date of Patent: Oct. 17, 2017

(54) LOCAL CLEAN ZONE FORMING APPARATUS

(75) Inventors: Yuki Fujishiro, Tokyo (JP); Kozo Nitta, Tokyo (JP); Yuji Kubota, Tokyo (JP)

(73) Assignee: Koken Ltd., Tokyo (JP)

( * ) Notice: Subject to any disclaimer, the term of this patent is extended or adjusted under 35 U.S.C. 154(b) by 647 days.

(21) Appl. No.: 13/578,938

(22) PCT Filed: Feb. 9, 2011

(86) PCT No.: PCT/JP2011/053315

§ 371 (c)(1),
(2), (4) Date: Aug. 14, 2012

(87) PCT Pub. No.: WO2011/099643

PCT Pub. Date: Aug. 18, 2011

(65) Prior Publication Data

US 2012/0322356 A1 Dec. 20, 2012

(30) Foreign Application Priority Data

Feb. 15, 2010 (JP) ..... 2010-30046

(51) Int. Cl.
*F24F 7/06* (2006.01)
*F24F 13/08* (2006.01)
(Continued)

(52) U.S. Cl.
CPC ..... *F24F 9/00* (2013.01); *F24F 3/1607* (2013.01)

(58) Field of Classification Search
CPC ..... F24F 9/00; F24F 3/1607
See application file for complete search history.

(56) References Cited

U.S. PATENT DOCUMENTS 1,958,995 A * 5/1934 Green ..... 454/146
2,332,351 A * 10/1943 Serre ..... F24F 13/081 454/335

(Continued)

FOREIGN PATENT DOCUMENTS

EP 0563509 A2 * 10/1993
JP 55-118754 9/1980

(Continued)

OTHER PUBLICATIONS

Kubota, JP2008-275266 A English machine translation, Nov. 13, 2008.*

(Continued)

*Primary Examiner* — Alissa Tompkins
*Assistant Examiner* — Phillip E Decker
(74) *Attorney, Agent, or Firm* — Greer Burns & Crain Ltd.

(57) ABSTRACT

Provided is a local clean zone forming apparatus which has an excellent operability and can provide an excellent clean air space without restricting the installation location or the purpose of an operation. In the local clean zone forming apparatus, a pair of push hoods having air blowing surfaces between which an airflow alignment mechanism is formed to form uniform airflows, are disposed so that the uniform airflows discharged from the push hoods are opposite to and collide with each other in a positional relationship wherein the air blowing surfaces are parallel to each other, and the centers of the air blowing surfaces are not directly opposite to each other; and the uniform airflows are obliquely discharged at an angle with respect to the air blowing surfaces.

13 Claims, 23 Drawing Sheets

(51) Int. Cl.
*F24F 9/00* (2006.01)
*F24F 3/16* (2006.01)

(56) References Cited

U.S. PATENT DOCUMENTS

| | | | | | |
|---|---|---|---|---|---|
| 2,982,197 | A * | 5/1961 | Roberts | F24F 13/075 | 454/316 |
| 3,046,866 | A * | 7/1962 | Straub | F24F 13/062 | 454/310 |
| 3,170,385 | A * | 2/1965 | Tompkins | F24F 9/00 | 454/191 |
| 3,255,686 | A * | 6/1966 | Eugene et al. | 454/188 | |
| 3,270,655 | A * | 9/1966 | Guirl | F24F 9/00 | 454/188 |
| 3,308,740 | A * | 3/1967 | Henson et al. | 454/188 | |
| 3,623,420 | A * | 11/1971 | Larkfeldt | F24F 13/06 | 454/305 |
| 3,910,504 | A * | 10/1975 | Laird | B05B 1/005 | 209/134 |
| 4,823,680 | A * | 4/1989 | Nowotarski | 454/188 | |
| 5,274,930 | A * | 1/1994 | Ensign | D21F 5/182 | 34/444 |
| 5,759,149 | A * | 6/1998 | Goldberg et al. | 600/22 | |
| 5,992,514 | A * | 11/1999 | Sugimoto et al. | 165/135 | |
| 6,146,267 | A * | 11/2000 | Beudon et al. | 454/188 | |
| 6,386,968 | B2 * | 5/2002 | Mehlman | F24F 9/00 | 454/190 |
| 6,733,557 | B1 * | 5/2004 | Beudon | F24F 9/00 | 454/187 |
| 7,160,362 | B2 * | 1/2007 | Terada | F24F 3/14 | 261/112.2 |
| 2006/0266267 | A1 * | 11/2006 | Albrecht | F15D 1/02 | 110/147 |
| 2007/0081888 | A1 * | 4/2007 | Harrison | 415/47 | |
| 2007/0144123 | A1 * | 6/2007 | Angadjivand | A62B 23/02 | 55/486 |
| 2009/0137198 | A1 * | 5/2009 | Tsubata | F24F 9/00 | 454/191 |
| 2009/0241888 | A1 * | 10/2009 | Koss | F02M 35/1216 | 123/184.53 |
| 2010/0233951 | A1 * | 9/2010 | Horowitz et al. | 454/188 | |
| 2014/0366498 | A1 * | 12/2014 | Suzuki et al. | 55/385.2 | |
| 2015/0059298 | A1 * | 3/2015 | Suzuki et al. | 55/385.2 | |

FOREIGN PATENT DOCUMENTS

| | | |
|---|---|---|
| JP | 63-176943 | 7/1988 |
| JP | 01-244226 | 9/1989 |
| JP | 02-282643 | 11/1990 |
| JP | 05-228335 | 9/1993 |
| JP | H06-057426 U | 8/1994 |
| JP | 2001-141273 | 5/2001 |
| JP | 2005-048970 | 2/2005 |
| JP | 2006-162174 | 6/2006 |
| JP | 2008-75945 A | 4/2008 |
| JP | 2008-275266 | 11/2008 |

OTHER PUBLICATIONS

Mikulla, et al, EP0563509 A2 English machine translation, Oct. 6, 1993.*

Kamiya, JP2008-075945 A English machine translation, Apr. 3, 2008.*

Definition of "parallelogram", Oxford English Dictionary, Third Edition, Oxford University Press, 2017.*

Int'l. Search Report issued in Int'l. App. No. PCT/JP2011/053315, dated Apr. 19, 2011.

Korean Office Action issued in counterpart Korean App. No. 10-2012-7023985, dated May 10, 2016.

* cited by examiner

| CLEANLINESS MEASUREMENT RESULTS(%) | | | | |
|---|---|---|---|---|
| ① | 100.000 | ④ | 100.000 | ⑦ | 99.950 |
| ② | 100.000 | ⑤ | 100.000 | ⑧ | 100.000 |
| ③ | 99.997 | ⑥ | 100.000 | ⑨ | 100.000 |

LOCAL CLEAN ZONE FORMING APPARATUS

This application is a U.S. National Phase under 35 U.S.C. §371 of International Application No. PCT/JP2011/053315, filed Feb. 9, 2011.

TECHNICAL FIELD

The present invention relates to a local clean zone forming apparatus for forming a clean air space in a work area.

BACKGROUND ART

In recent years, the need for cleaner work space has grown in locations such as manufacturing locations for highly functional precision equipment such as optical parts, including digital cameras, cell phones, semiconductor manufacturing including IC chip manufacturing, production of liquid crystal parts such as flat-panel displays, and manufacturing, inspection and research locations that handle chemicals, pharmaceuticals and/or the like due to the large effect the mixing of dust, environmental microbes and/or the like has on product quality and research results.

In response to these needs, methods that locally clean only a portion of the work space that needs to be cleaned are typical, and a clean bench method is a representative clean zone forming technology. This clean bench method has a work opening only in front of the work table, and other surfaces are enclosed, including the ceiling, in order to maintain cleanliness. A clean air blowing opening is positioned inside this enclosure, and a worker does the work by inserting his hands through the work opening in front of him. Clean benches with various functions appended have been proposed on this basic structure. Examples of commonly known publications proposing such a clean bench include JP2001-141273A, JP2005-48970A and JP2006-162174A.

Clean benches known from before had difficulty in operability in that many had small work openings, making assembly work on precision equipment difficult. In addition, in assembly work on production lines such that products and parts are manufactured while being transported by a conveyor and/or the like, the clean bench method could not be adopted on production lines because the indispensable enclosure became a hindrance.

In this case, a clean room method in which an entire work room including the production line is cleaned is used, but this approach causes facilities to become large-scale, creating difficulties in securing installation space needed for larger systems and causing the expense of the system itself as well as installation costs to rise. Moreover, operating costs, such as electricity bills and replacement filter maintenance expenses needed to maintain high cleanliness in this broad space, become enormous.

Besides these, another method for manufacturing production parts and/or the like without contamination is a mini environment method that partially controls contamination inside a barrier by isolating the worker, but while this can create a highly clean zone, it is necessary to completely isolate the worker and the production parts and/or the like, making it impossible for the worker to directly do the work.

The present inventor and others proposed a local air cleaning apparatus in which a pair of push hoods are arranged facing each other so that the two airflows collide, as a local air cleaning apparatus that has excellent operability and can provide an excellent clean zone without restricting the purpose of an operation (JP2008-275266A).

This apparatus can form a clean air space without using a wall or enclosure, with boundary surfaces parallel to the airflow direction formed between the air blowing surfaces of the pair of facing push hoods all being in an open state, and thus has excellent operability because there is no hindrance to the operation by an enclosure and/or the like. In addition, because there is no enclosure, it is possible to use a production line accompanying transport of the parts. However, in the case of this apparatus it is necessary to have the blowing opening surfaces face each other, so in some cases it is difficult to accomplish work without the worker himself entering the formed airflow on a production line accompanying parts transport, and in such a case, a clean zone cannot be formed because the worker obstructs the air blowing surface of the push hoods. In addition, in locations having difficult-to-move obstacles such as pillars, manufacturing equipment and/or the like in the apparatus installation area, and in confined work rooms and/or the like, installation with a positional relationship such that the blowing opening surfaces face each other is impossible, creating the problem that even if the equipment can be installed, unnecessary space is used.

DISCLOSURE OF INVENTION

Objective of the Invention

It is an object of the present invention to provide a new local clean zone forming apparatus that can enhance practicality and applicability, possesses excellent operability, does not restrict the purpose of an operation, reduces apparatus installation space, and provides an excellent clean zone easily and inexpensively, utilizing the advantages of the local air cleaning apparatus proposed before.

SUMMARY OF THE INVENTION

The present invention is, point one, a local clean zone forming apparatus in which a pair of push hoods having an alignment mechanism for forming uniform airflow installed inside an air blowing surface are disposed so that the uniform airflows discharged from the push hoods are opposite to and collide with each other in a positional relationship wherein the air blowing surfaces are parallel to each other and the centers of the air blowing surfaces are not directly opposite each other, and the uniform airflows are obliquely discharged at an angle with respect to the air blowing surfaces.

The present invention is, point two, the local clean zone forming apparatus of point one above, wherein the alignment mechanism is composed of at least one honeycomb-shaped parallel porous body and at least one air resistor, and the porous section of the honeycomb-shaped parallel porous body is positioned at an angle in an oblique direction with respect to the air blowing surface.

The present invention is, point three, the local clean zone forming apparatus of point two above, wherein the porous section of the honeycomb-shaped parallel porous body of the alignment mechanism is positioned at an angle in a horizontal oblique direction with respect to the air blowing surface.

The present invention is, point four, the local clean zone forming apparatus of point three above, wherein when the push hood is viewed from the top surface direction, at least one of the two side surfaces abutting a boundary of a housing surface having the air blowing surface of a housing forming the external shape of the push hood is parallel to the angle of the uniform airflow discharged in a horizontal oblique direction with respect to the air blowing surface.

The present invention is, point five, the local clean zone forming apparatus of point four above, wherein when the push hood is viewed from the top surface direction, in a push hood in which the angle formed by the surface having the air blowing surface of the housing forming the external shape of the push hood and the side surface abutting the boundary is an oblique angle and that side surface is parallel to the angle of the uniform airflow discharged in a horizontal oblique direction with respect to the air blowing surface, a shielding plate is disposed in a vertical direction from the top edge to the bottom edge of the air blowing surface and from the air blowing surface in the push hood forming the side surface of the obtuse angle to the back surface housing on the other side facing the air blowing surface.

The present invention is, point six, the local clean zone forming apparatus of any of points one to five above, wherein all boundary surfaces of the clean zone parallel to the airflow direction of the clean zone formed between the air blowing surfaces of the pair of push hoods are in an open state.

Efficacy of the Invention

By having a pair of push hoods discharging uniform airflows obliquely discharged at an angle with respect to the air blowing surfaces such that these uniform airflows are opposite to and collide with each other, the local clean zone forming apparatus of the present invention can form a clean zone between the air blowing surfaces of this pair of push hoods, and consequently, it is possible to form a clean zone having a high degree of cleanliness even without an enclosure such as a clean bench, and because there is no enclosure to become a hindrance to work, the operability of workers in the clean zone is excellent and there are no limits on the targets of those operations.

In addition, because the local clean zone forming apparatus of the present invention can blow obliquely at an angle with respect to the air blowing surfaces having no enclosure, it is possible to form a clean zone by causing the uniform airflows interposed obliquely by the pair of push hoods to collide only in the target work area of the production line, and it is possible to easily form a clean zone locally without needing to enclose the production line as a whole or requiring large-scale equipment for cleaning the work room as a whole. In addition, installation space for the apparatus is conserved, the apparatus itself and installation expenses and/or the like become less expensive and only the necessary local space is cleaned, so that it is possible to reduce maintenance expenses such as needless replacement filters and/or electric bills. Furthermore, there are no hindrances to forming a clean zone caused by large disturbances in the airflow because workers' bodies are in the airflow forming the clean zone, making it possible to maintain the clean zone because it is possible to work with only the part of the body from the arms outward in the airflow of the clean zone.

In addition, even when there is an obstruction in the apparatus installation that would be difficult to move, such as a pillar, production equipment and/or the like, the local clean zone forming apparatus of the present invention causes uniform airflows discharged from the pair of push hoods to blow obliquely opposite each other avoiding the obstruction, and consequently it is possible to form a clean zone to match obstructions and the structure of the work room. In addition, it is possible to form a clean zone even in narrow work rooms in which installation was impossible before, and it is possible to efficiently utilize work areas, with installation space effectively reduced.

In addition, from before there have only been push hoods that blow air in a direction perpendicular to the air blowing surfaces, but in the present invention, the apparatus has a function for discharging air obliquely at an angle with respect of the air blowing surfaces of the push hoods. The user or installer of the apparatus of the present invention could have difficulty determining at what angle the air is to be discharged, so by forming at least one out of the two side surfaces abutting the boundary and the housing surface having the air blowing surfaces parallel to the angle of uniform airflow discharged obliquely at an angle with respect to the air blowing surfaces, it is possible to determine through nothing more than seeing the external appearance of the push hoods at what angle that apparatus will discharge airflow.

With the local clean zone forming apparatus of the present invention, the air blowing surfaces of the pair of push hoods can be freely arranged in an arbitrary range or height from the floor surface to the ceiling, and it is possible to freely provide the range of the clean zone to match the work or application.

In addition, with the local clean zone forming apparatus of the present invention the push hood devices themselves can be formed relatively compactly, and consequently it is possible to easily move the apparatus by providing a movement means such as casters and/or the like on the apparatus as necessary, broadening response to changes in work layout or variations in apparatus application such as movement between work rooms.

MODE FOR CARRYING OUT THE INVENTION

Figure 1:
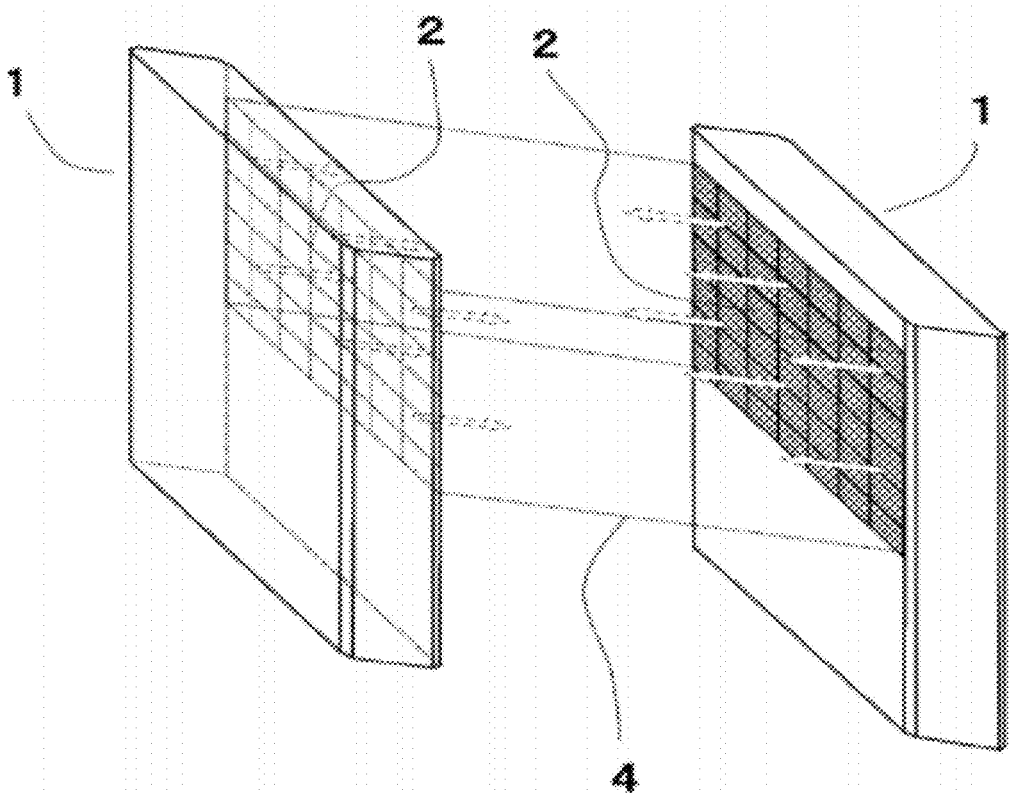
FIG. 1 is an oblique view showing an installation example of a local clean zone forming apparatus using a pair of push hoods of the present invention.

The local clean zone forming apparatus of the present invention causes uniform airflow discharged obliquely with respect to air blowing surfaces from a pair of push hoods to be opposite each other, but as the push hoods for discharging uniform airflows used in the present invention, it is possible to utilize the push hood structure used in push-pull type ventilation devices known from before as a basis, and it is possible to add a composition for discharging obliquely to create the push hood used in the present invention. A representative example of the local clean zone forming apparatus composed of a pair of push hoods in the present invention is shown in FIG. 1.

This uniform airflow is also called uniform captured airflow or laminar flow and when viewed in a cross-section perpendicular to the airflow discharged from the air blowing surfaces, is said to be airflow in a state such that the magnitude of the speed of the flow is effectively constant at the place of arrival at that cross-section, and preferably the dispersion of the speed distribution in a state with no obstructions is within ±50% of the average value (a condition established by the Minister of Health, Labor and Welfare based on the stipulations in the dust obstruction prevention regulation Dust Regulation Article 11, Paragraph 2, No. 4 (according to Fiscal 1998 Health, Labor and Welfare Minister Notice No. 30)), and more preferably is within ±20%.

In addition, the wind speed suitable for uniform airflows preferably has an initial speed discharged at the air blowing surface that is a low speed of around 0.3 to 1.5 m/second, and this airflow, when discharged from the air blowing surfaces, flows so as to carry the air of the entire cross-section of the airflow slowly toward the direction discharged from the air blowing surfaces.

In the push hoods, the housing forming the external appearance of the push hoods and the alignment mechanism installed therein are preferably made from shapes having numerous linear parts that can be linearly processed, such as cutting, bending or welding, for reasons of manufacturing efficiency, and in addition this shape is preferably similar when viewed from area efficiency of the air blowing surfaces. Consequently, the air blowing surface for forming this uniform airflow is preferably made square or rectangular, and more preferably is made a quadrilateral ranging from a rectangular shape with a 5:1 ratio of long sides to short sides to a square shape. However, in cases in which emphasis is given to design and it is not necessary to give consideration to loss in manufacturing or construction, it is possible to arbitrarily select a circle or another free shape.

Figure 2A:
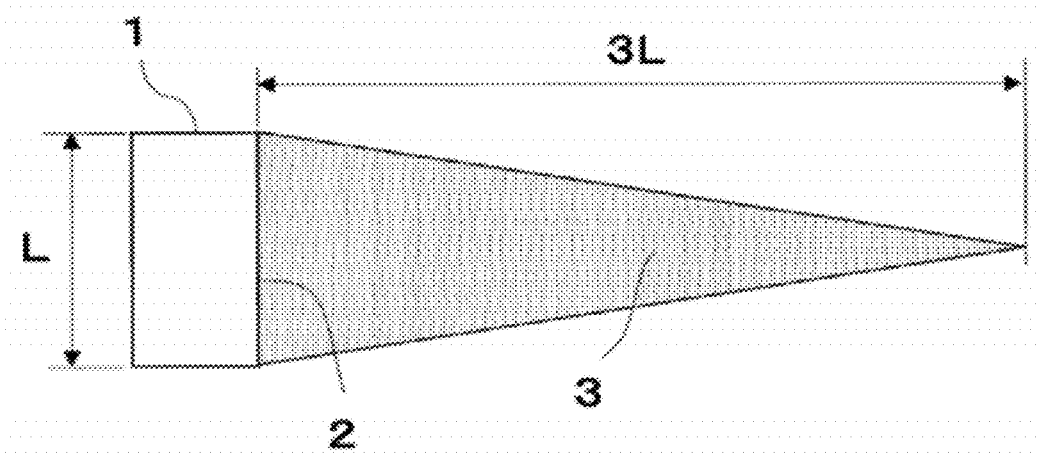
FIG. 2A is a drawing showing uniform airflow space formed from one push hood.

Not being limited to uniform airflows, the airflow diffuses toward the front at an angle of around 10° when typically discharged, and the range of maintaining a uniform airflow narrows in accordance with distance blown from the air blowing surfaces. FIG. 2A is a drawing showing the uniform airflow space as seen from the short side direction formed from one of the push hoods, but the range where the uniformity of the uniform airflow discharged from the one push hood 1 in the drawing can be maintained is dependent on the distance of the short side L of the rectangular shape, including a square shape, air blowing surface 2. When that distance is roughly three times the short side L of the air blowing surface 2, that uniform airflow space when viewed from the short side direction has area 3 in the shape of an isosceles triangle with the short side L of the air blowing surface 2 as the base and connecting the center of the air blowing surface 2 at three times that distance, and when viewed from the long side direction, has a trapezoidal shape (unrepresented) with a base (long side), top (long side—L) and height (3L).

Figure 2B:
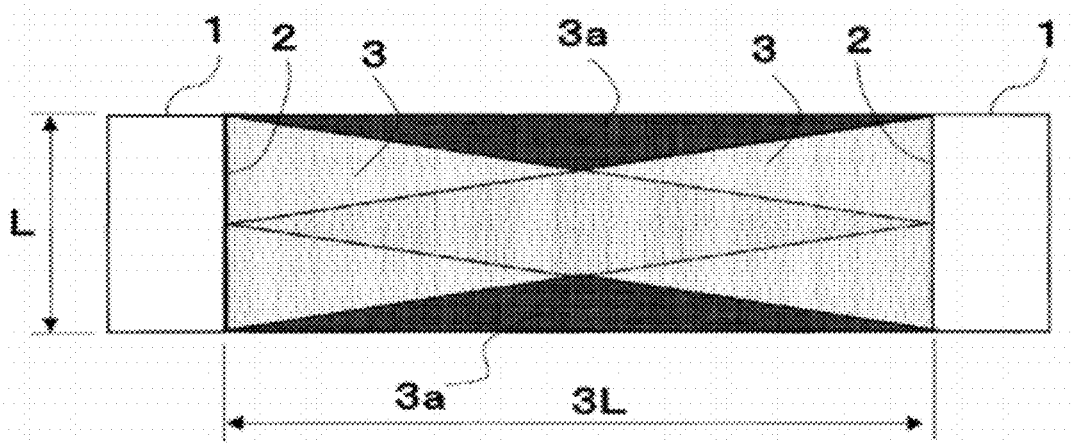
FIG. 2B is a drawing showing uniform airflow space formed when a pair of push hoods are installed so that the airflows face each other.

FIG. 2B is a drawing showing the uniform airflow space formed when a pair of push hoods are installed so as to face each other, and shows the airflow used in the present invention. As shown in FIG. 2B, when the airflows 3 of the pair of push hoods 1 blowing uniform airflows are installed so as to face each other at three times the distance of the short side L of the air blowing surface 2, the range where the uniform airflow can be formed is an area that contains the overlapping part of uniform airflows 3 such that an isosceles triangle having the short side L of the air blowing surface 2 as a base and connecting the center of the air blowing surface 2 at three times the distance thereof is positioned with the base of the isosceles triangle at the respective air flow surfaces 2 of the opposing push hoods 1, but in reality those two uniform airflows 3 do not overlap, for the two uniform airflows 3 collide near the middle of the pair of push hoods 1, and following this the airflow changes orientation to a perpendicular direction with respect to the flow direction to that point, and is pushed out of the uniform airflow space 3 formed between the pair of push hoods 1. That is because the uniform airflows 3 are continuously discharged from the push hoods 1. As shown in FIG. 2A with only the airflow discharged form one push hood 1, the uniform airflow space 3 tapers off in accordance with the distance discharged from the air blowing surface 2, but as shown in FIG. 2B, by causing the uniform airflows discharged from the pair of push hoods to collide, the airflows collide with virtually no tapering off, so that uniform airflow is formed even in the location labeled 3*a* in which uniform airflow cannot be formed with a single push hood, the orientation of the airflow in the perpendicular direction changes including the airflow in the surroundings of the collision, and as shown in FIG. 1, all of the boundary surfaces linearly linking the four sides of the air blowing surfaces 2 of the pair of push hoods have air space with an open condition formed. In other words, in the product of the long side of the air blowing surface 2 and the area found by multiplying the short side L of the air blowing surface 2 with three times the short side L, it is possible to form a uniform airflow space. In the present invention, high-performance filters are preferably housed inside the push hoods, and the space thus formed becomes a clean zone in accordance with the performance of the filters.

Air curtains exist as airflows that tend to intermix with uniform airflows, but air curtain airflow creates a curtain of wind through a forceful jet discharged from a slit-shaped air discharge section in the shape of a flat rectangle, and by partitioning the space with this, a variety of air doors can be formed for purposes such as dust prevention, odor prevention, insect prevention and heat insulation. The wind speed of the air blowing part of this air curtain airflow has an initial velocity of around 5-10 m/s, with some having wind speeds that are extremely fast compared to the wind speed of the uniform airflow. This is because if the wind speed is not fast, it becomes impossible to form an air curtain to a distance, and because the slit-shaped air discharge part is a flat rectangular shape, the short side must become short, and airflow with virtually no uniformity results. When this air curtain airflow is adopted in the present invention, not only does the airflow not possess uniformity, but when a worker tries to work in the airflow, the wind speed of the airflow is too fast, and airflow colliding with the worker, manufactured parts and/or the like rebounds, creating turbulent flow. Because turbulence that has thus rebounded is created it is impossible to form a uniform airflow space, and as a result it becomes impossible in practice to form a clean zone.

Here, a push hood suitable for use in the present invention will be described. In the push hood, as a housing covering the apparatus it is possible to use one having an appropriate shape taking into consideration design and materials such as the alignment mechanism installed inside, through bending or pressing steel sheet 0.3 to 5.0 mm in thickness. In addition, after the framework of the apparatus as a whole is formed by assembling metal L-shaped frames and/or the like, it is possible to also form a housing structure whose apparatus surface is covered by metal or a composite resin sheet and/or the like. The push hood housing is not limited to such a structure or materials, and can use an appropriate structure taking into consideration the weight of the alignment mechanism and/or the like installed inside. As the preferred housing structure of the present invention, when productivity is taken into consideration, it is especially preferable to form a housing by linearly bending, cutting and welding stainless steel sheet 1.0 to 1.6 mm in thickness to balance processability and strength.

On one surface of the housing is the air blowing surface, and in this air blowing surface a sheathing is preferably provided in order to protect the ventilation surface of the neighboring alignment mechanism inside the apparatus. There are no restrictions on this sheathing material, and steel or resin can be appropriately selected. It is possible to form the sheathing freely on the air blowing surface as a whole by assembling wires having a cross section of ϕ 0.5 to ϕ 10.0 mm, squared materials having a cross section of □ 0.5 to □ 10.0 mm or squared materials having a cross section of 0.5 to 10.0 mm×1.0 to 100.0 mm horizontally, vertically and obliquely. This sheathing is preferably formed in a sparse space so as to not have an effect on airflow such as wind speed or wind direction and/or the like of the airflow passing through from the alignment mechanism. In addition, this sheathing can use a metal or plastic mesh. There are no restrictions on the method of anchoring this sheathing, and anchoring can be accomplished by welding such to the perimeter of the air blowing surface from the inside of the housing, or providing a frame on the housing, and/or the like.

On the inside of the sheathing 12 of the air blowing surface, an alignment mechanism 6 formed so as to discharge uniform airflow from the air blowing surface 2 is provided in the gap between the air blowing surface 2 and the sheathing 12, positioned so as to overlap the ventilation surface of the air blowing surface 2. The alignment mechanism 6 is formed by overlapping multiple materials having an area that is the same as or somewhat larger than the area of the air blowing surface 2. On the downstream side of the alignment mechanism 6, that is to say at a position most closely abutting the air blowing surface 2, at least one honeycomb-shaped parallel porous body 10 is positioned, and on the upstream side thereof at least one air resistor 11 is preferably positioned. The alignment mechanism 6 first corrects airflow having deviation in ventilation amount with respect to the air blowing surface 2 as a whole being blown from the upstream side of the alignment mechanism 6 and produces homogenized airflow with no deviation from the air blowing surface 2 as a whole. Next, by giving direction to the airflow made uniform by the air resistor 11 in the honeycomb-shaped parallel porous body 10, stabilizing the direction of the uniform airflow and discharging such from the air blowing surface 2, it is possible to form a stable uniform airflow space.

In the present invention, the honeycomb-shaped parallel porous body 10 means a porous body having multiple porous bodies in parallel, with the diameter, in other words, depth of a vertical cross section large compared to the diameter of a horizontal cross-section of a unit porous body. Accordingly, the parallel porous bodies are not limited to the narrowly defined honeycomb structure but can encompass those in which the horizontal cross-sectional shape is circular or polygonal with at least three sides. The diameter of the horizontal cross-section of a unit porous body is preferably 1-10 mm, and the ratio of the depth to this diameter is preferably 1:1.2 to 1:5. In addition, metals such as stainless steel, aluminum and/or titanium, or synthetic resins such as vinyl chloride are representative of the materials for these honeycomb-shaped parallel porous bodies 10, but the materials are not particularly limited in the present invention.

The air resistor 11 used in the present invention is a blown air resistor for correcting homogenized airflow having a deviation in ventilation amount with respect to the air blowing surface 2 as a whole blown from the upstream side of the alignment mechanism 6 into uniform airflow with no deviation. The air resistors can suitably be made using materials such as punching boards, mesh materials, nonwoven cloth or a filter material such a pre-filter, a neutral filter and/or the like. Of these, the preferable shape when a punching board is used in the air resistor is one having a circular shape or polygonal shape with at least three sides or various other shapes for the shape of the holes in the punching board, but the hole shape or lines or gaps is such that the smaller the variance in the opening ratio per unit area in the punching board itself, the more preferable. In addition, when mesh materials are used in the air resistor, it is possible to appropriately use a mesh working as an air resistor from among various mesh materials, for example, metal mesh such as plain weave, twill weave, plain mat weave, twill mat weave and/or the like, or sintered metal mesh or synthetic resin mesh. In addition, it is possible to appropriately use those discovered to act as air resistors when using nonwoven cloth in the air resistor, undertaking air resistance even when using a filter in the air resistor.

Figure 3A:
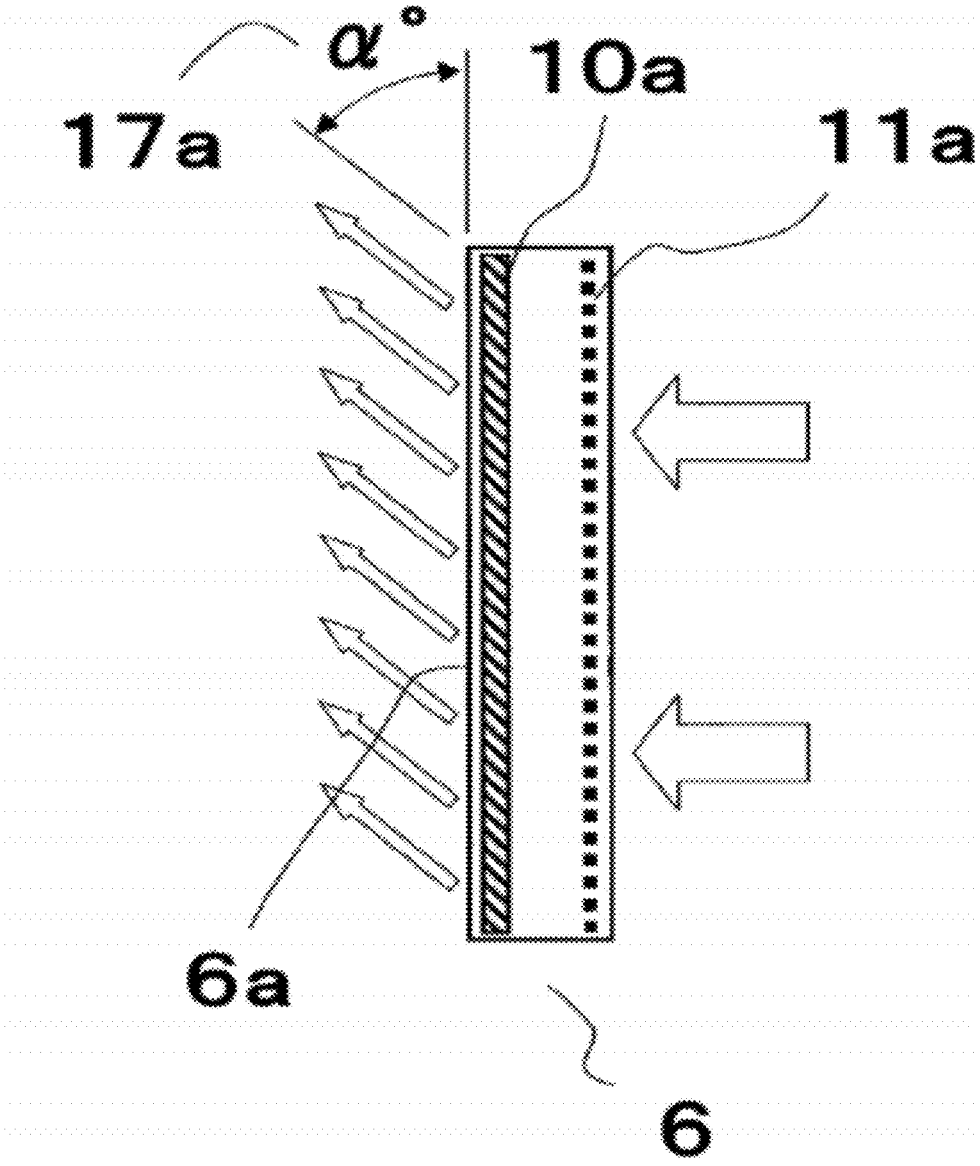
FIG. 3A is a top cutaway view showing an representative example of an airflow alignment mechanism used in the present invention.
Figure 3B:
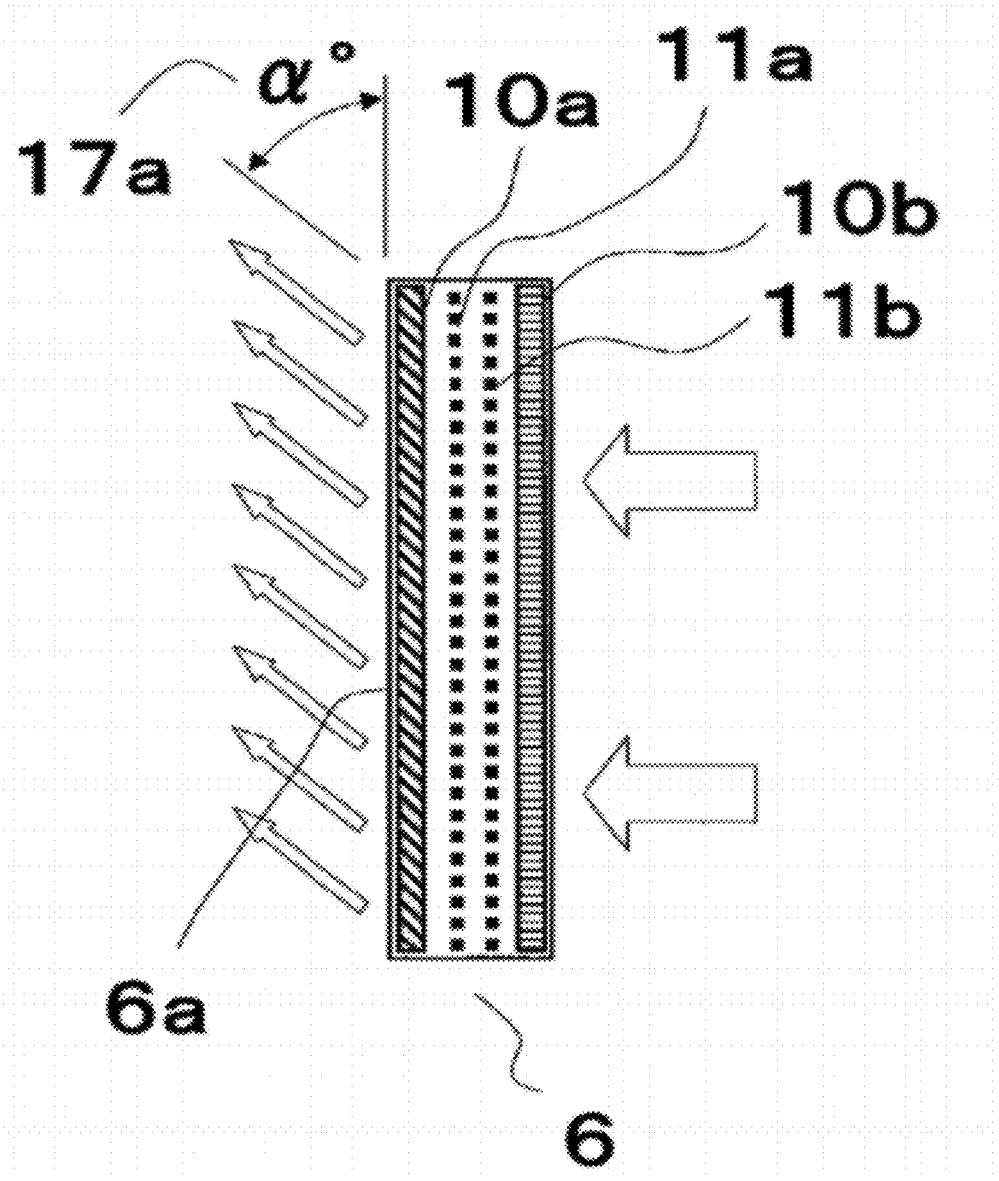
FIG. 3B is a top cutaway view showing an representative example of an airflow alignment mechanism used in the present invention.
Figure 3C:
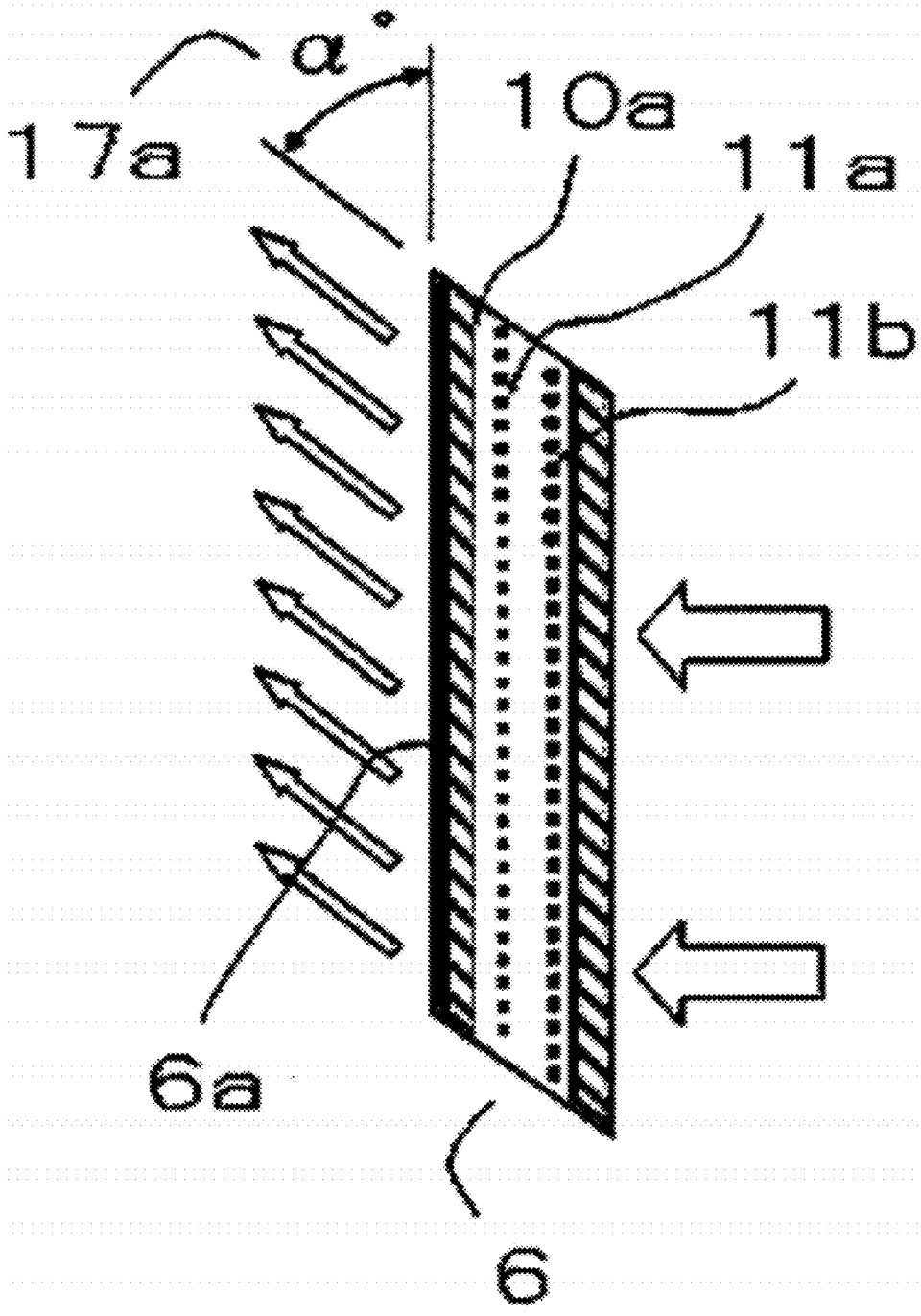
FIG. 3C is a top cutaway view showing an representative example of an airflow alignment mechanism used in the present invention.

FIGS. 3A, 3B, 3C and 3D are top cross-sectional views showing examples of the alignment mechanism 6 in the push hood of the present invention when air has been discharged from the alignment mechanism 6 at an oblique angle α 17*a*. In FIG. 3A, a honeycomb-shape parallel porous body 10*a* having an angle 17*a* of the porous body along the air blowing surface 2 of α° and on the upstream side of this an air resistor 11*a* composed of a punching board with a gap to the honeycomb-shaped parallel porous body 10*a* are disposed. The airflows having a deviation in ventilation amount with respect to the air blowing surfaces 2 as a whole are made uniform by the air resistor 11*a* of the alignment mechanism 6, and the airflow passing through has its flow changed and aligned to the angle α 17*a* by the honeycomb-shaped parallel porous body 10*a*, and this is the basic structure of the alignment mechanism 6 used in the present invention. Through this basic structure, dispersion of the speed distribution is kept within ±50% of the average value. This angle α 17*a* can be appropriately selected in accordance with the apparatus usage method and/or the like within a range of larger than 10° and smaller than 90° with respect to the air blowing surface 2. Typically, it is preferable to select a range of 30° to 85° with respect to the air blowing surface 2 because this yields effective results. In addition, this angle α 17*a* is not limited to the horizontal direction, for discharging at an arbitrary angle from the air blowing surface is possible. In FIG. 3B, a honeycomb-shaped parallel porous body 10*a* having an angle 17*a* of α° of the porous unit along the air blowing surface 2 and to the upstream side two air resistors 11*a* and 11*b* composed of punching boards having the same aperture ratio are disposed, with gaps between the honeycomb-shaped parallel porous body 10*a* and the respective air resistors 11*a* and 11*b*, and furthermore a honeycomb-shaped parallel porous body 11*b* the angle of whose porous body is perpendicular is positioned to the upstream side. This alignment mechanism 6 changes and aligns the flow of the airflow to the angle α 17*a* by the last honeycomb-shaped parallel porous body 10*a*, the same as in the alignment mechanism 6 of FIG. 3A. However, compared to the alignment mechanism 6 of FIG. 3A, an air resistor 11*b* and a honeycomb-shaped parallel porous body 10*b* whose resistor angle is perpendicular are added, and through this the direction of the airflow is aligned by the honeycomb-shaped porous body 10*b* added at the entrance of the alignment mechanism 6, and then dispersion of the ventilation amount is corrected in the first air resistor 11*b* and from then on is the same as the alignment mechanism of FIG. 3A. Through this, the direction and uniformity of the airflow are aligned to a certain extent at a stage earlier than passing through the alignment mechanism of FIG. 3A, which is the basic structure of the present invention, and consequently it is possible to keep dispersion of the speed distribution to within ±30% of the average value. In FIG. 3C, the honeycomb-shaped parallel porous body 10*b* of FIG. 3B is changed to a honeycomb-shaped parallel porous body 10*c* with the same angle α as the porous unit of the honeycomb-shaped parallel porous body 10*a*, and makes a parallelogram shape so that the alignment mechanism 6 as a whole is parallel to the angle α of the porous unit of the honeycomb-shaped parallel porous body 10*a*, so that the air is discharged obliquely at the angle α 17*a* from the honeycomb-shaped parallel porous body 10*c* at the opening of the alignment mechanism 2 to the honeycomb-shaped parallel porous body 10*a*. As the alignment mechanism, whether the angle of the porous body of the honeycomb-shaped parallel porous body at the opening of the alignment mechanism 6 is arranged at the same angle α 17*a* as the honeycomb-shaped parallel porous body 10*a* on the side of the air blowing surface 2 or is arranged perpendicularly, either can be selected and it is possible to keep the dispersion of the speed distribution to within ±30% of the average value in FIG. 3C similar to FIG. 3B, and with regard to FIG. 3C, because the angles of the porous units of the two honeycomb-shaped parallel porous bodies 10*a* and 10*c* are the same, common materials can be designed.

Figure 3D:
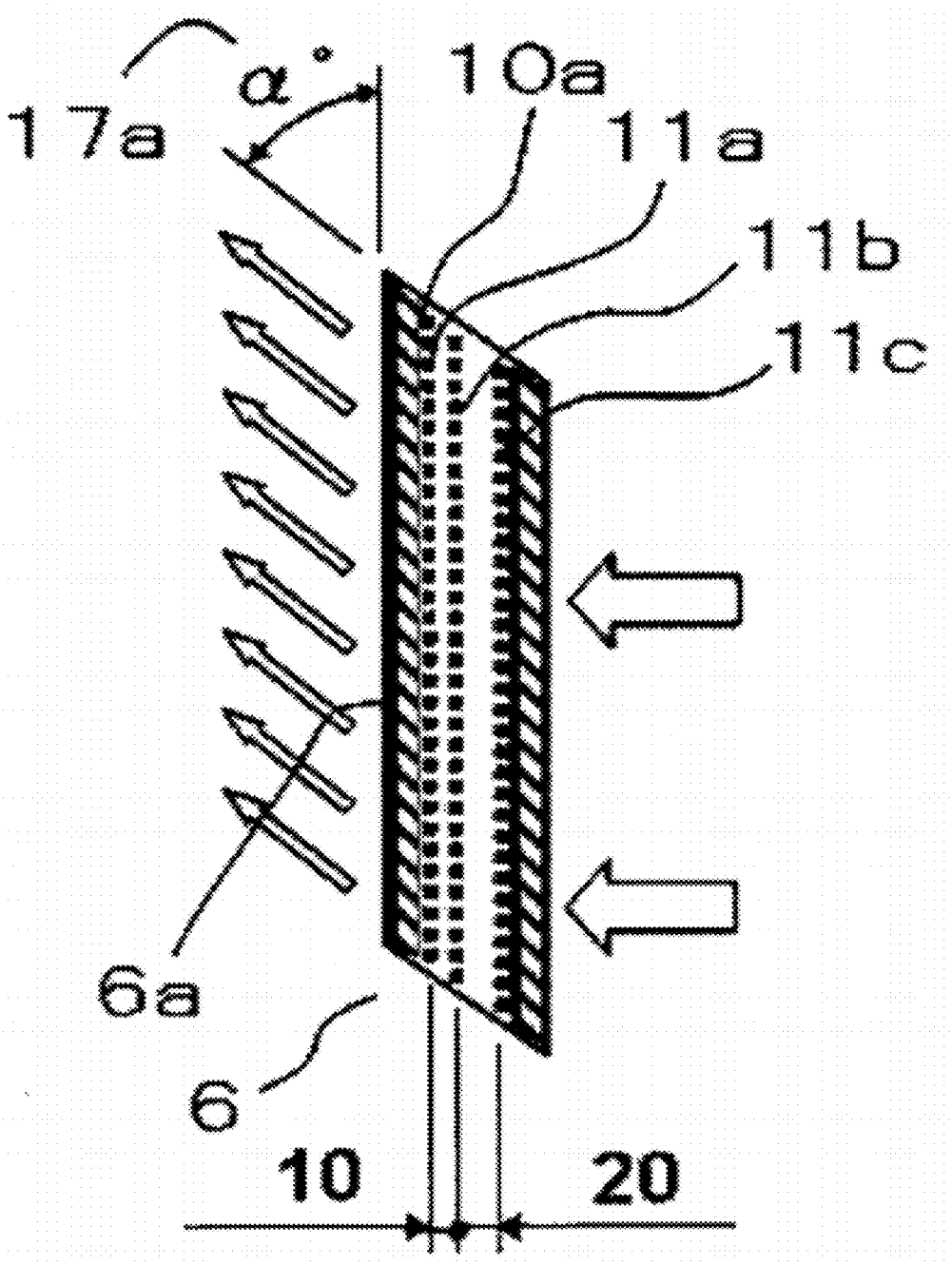
FIG. 3D is a top cutaway view showing an representative example of an airflow alignment mechanism used in the present invention.

In FIG. 3D, an air resistor 11*c* composed of a punching board having the same aperture ratio as the air resistors 11*a* and 11*b* is further added to FIG. 3C, so that the total number of air resistors used in three, but gaps of 10 mm and 20 mm are provided from the porous board 11*a* on the downstream side toward the upstream side. Through this, it is possible for the airflow having deviation in ventilation amount with respect to the air blowing surface 2 as a whole to be more precisely corrected and made uniform. The alignment mechanism 6 illustrated in FIG. 3D causes improved uniformity in the uniform airflow, and furthermore is a particularly preferable configuration for yielding the effect of broadening that uniform airflow forming space. In addition, as the composition of the alignment mechanism 6 discharging the uniform airflow, it is possible to appropriately alter the number, order or gaps between the air resistors 11 and the honeycomb-shaped parallel porous bodies 10.

In addition, the wind speeds of the uniform airflows that are caused to oppose each other are preferably equal in order to obtain balance in the clean zone.

In the housing 13 of the push hood 1, a cylinder having a somewhat larger shape than the external shape of the alignment mechanism 6 is provided, and on the inside of this cylinder the honeycomb-shaped parallel porous bodies 10 and air resistors 11 that are the constituent components of the alignment mechanism 6 are preferably housed in a sealed state, linearly and with appropriate spacing, using packing in each alignment mechanism member. The method of anchoring the alignment mechanism to the push hood of the present invention is not restricted to this structure, for an appropriate structure may also be used.

With the present invention, in order to form a clean zone preferably a high-performance filter 7 corresponding to the cleanliness level of a HEPA filter, an ULPA filter and/or the like is housed inside the push hood 1, and with the present invention it is especially preferable for this to be arranged with the ventilation surfaces overlapping linearly on the upstream side of the alignment mechanism 6 so there is less loss of space in the layout of the push hood 1. In addition, with the local clean zone forming apparatus of the present invention, airflow is generated using a blowing device such as a blower and/or a fan, and consequently, a pre-filter or a medium-performance filter 9 is provided on the upstream side of this blowing device 8, and preferably air is filtered to a certain extent in advance on the most upstream side of the push hood to protect the blowing device 8 positioned on the downstream side thereof and to also control clogging of the high-performance filter 7 positioned on the still further downstream side.

Figure 4A:
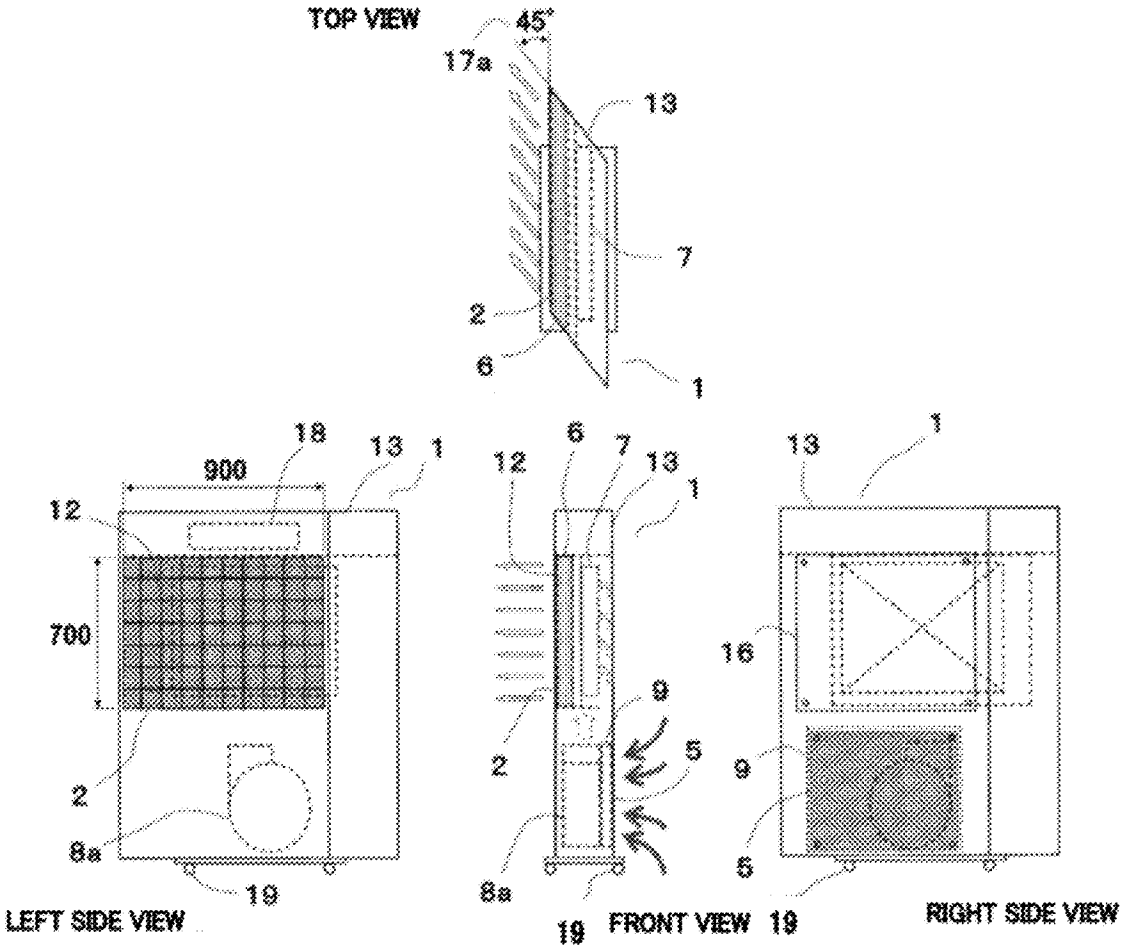
FIG. 4A is four surface views showing representative examples of push hoods used in the present invention.
Figure 4B:
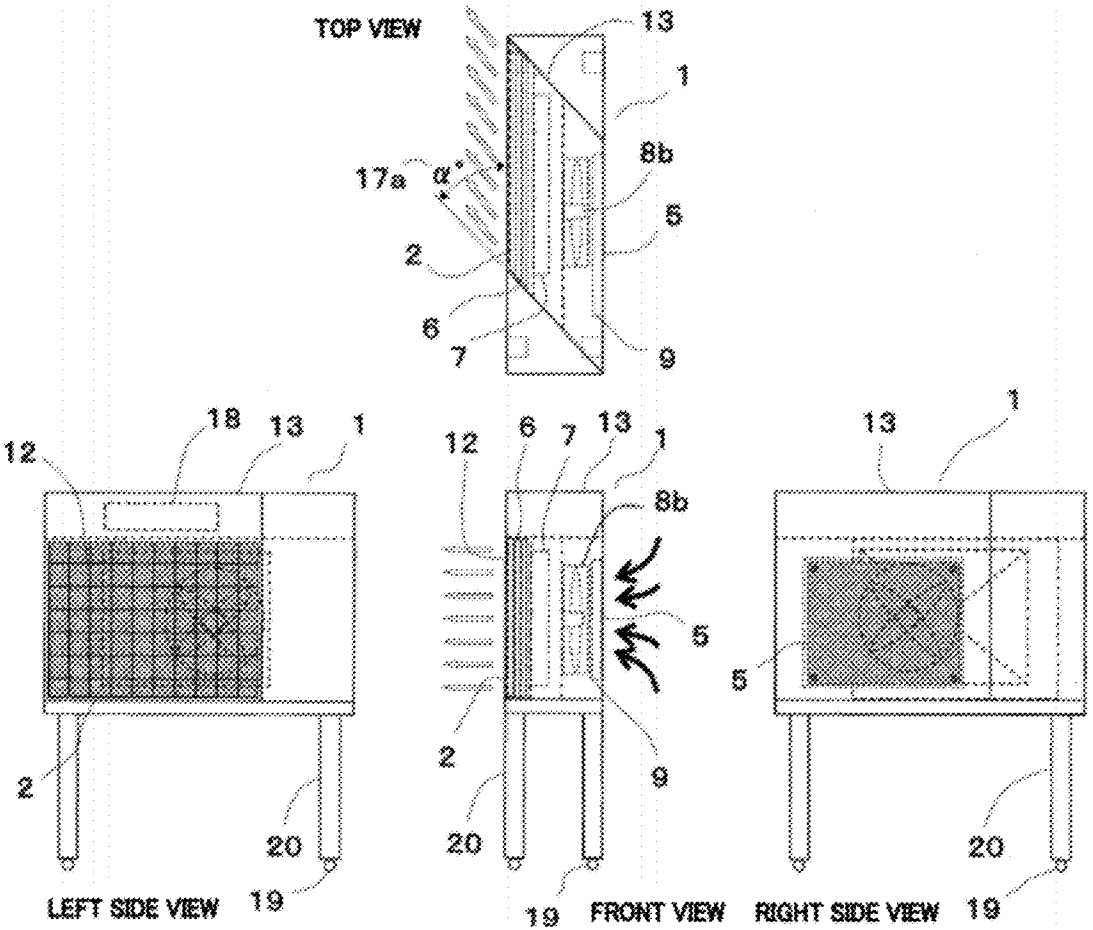
FIG. 4B is four surface views showing representative examples of push hoods used in the present invention.
Figure 4C:
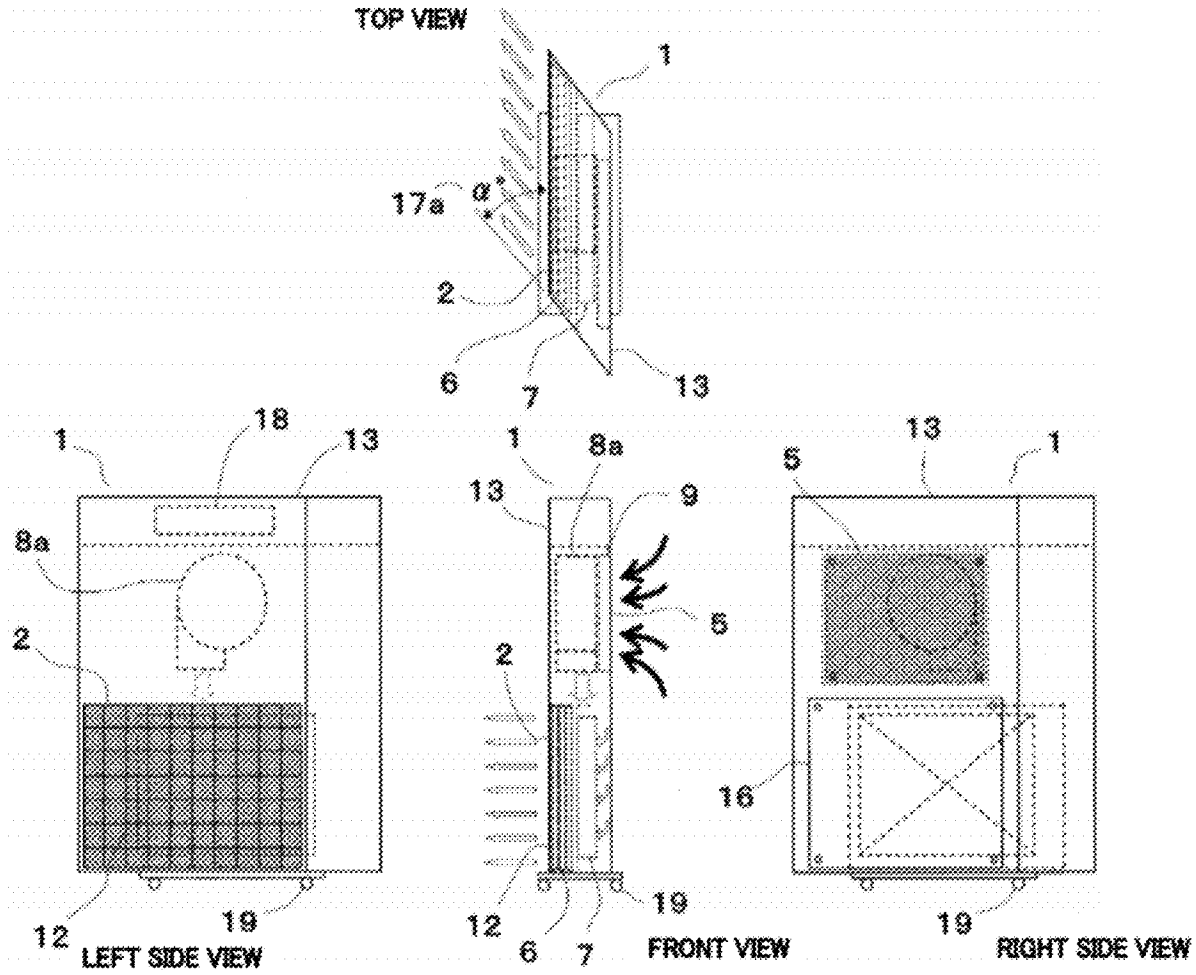
FIG. 4C is four surface views showing representative examples of push hoods used in the present invention.
Figure 4D:
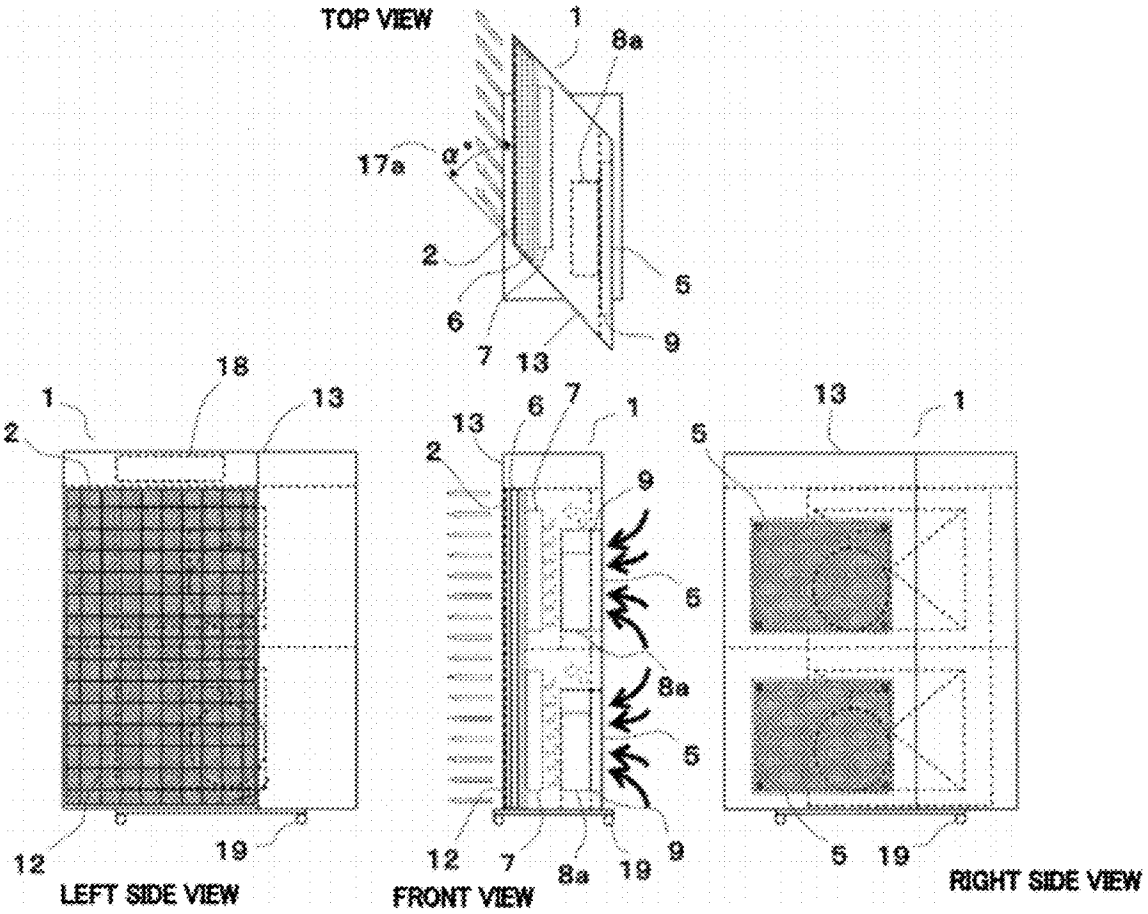
FIG. 4D is four surface views showing representative examples of push hoods used in the present invention.

As the blowing mechanism 6 of the push hood 1, there are those housed inside the push hood 1 main body and those provided separate from the push hood 1 main body, and when the blowing mechanism 8 is housed inside the push hood 1 maid body, a fan is housed inside the push hood 1 main body to cause air to pass on the upstream side of the high-performance filter 7, and a centrifugal fan 8*a* or an axial flow fan 8*b* is used as this fan. FIGS. 4A, 4B, 4C and 4D illustrate preferred embodiments of the present invention. In FIG. 4A, there is an air blowing surface 2 in the upper part of the push hood 1, on the top side of this an alignment mechanism 6 and a high-performance filter 7 are housed and on the bottom side a centrifugal fan 8*a* is housed, and an air intake opening 5 is provided on the lower back surface on the side opposite the air blowing surface 2 of the push hood 1. On this air intake surface 5, a mesh such as the welded mesh also used on the air blowing surface 2, or various mesh materials or the punching board used in the air resistor 11 of the alignment mechanism 6, can be appropriately used and preferably possesses enough breathability to not exert an influence on the suction force of the centrifugal fan 8*a*. Air from outside the push hood is sucked in from the air intake opening 5 by the centrifugal fan 8 housed inside the push hood 1, and relatively coarse dust and/or the like contained in the air sucked in from outside the apparatus is removed by the pre-filter 9 provided on the upstream side of the centrifugal fan 8*a*. The air filtered by the pre-filter 9 passes through the centrifugal fan 8*a* and flows to the back side which is the side opposite the air blowing surface on the upper side of the apparatus in the push hood 1. Next, fine dust and/or the like is filtered out in a high-performance filter 7 such as a HEPA filter and/or the like, and the airflow is aligned in the alignment mechanism 6 and is discharged from the welded mesh sheathing 12 of the air blowing surface 2 as uniform airflow at an angle of 45° with respect to the air blowing surface 2. In this manner, the thickness of the push hood 1 main body can be made thinner by not linearly arranging the alignment mechanism 6, the high-performance filter 7 and the centrifugal fan 8*a* which is the blowing device. The mesh member of the air intake opening 5 on the back surface of the push hood 1 is anchored by cosmetic screws and/or the like so as to be easily removable so that the pre-filter 9 can be removed from the push hood 1 and exchanged if the pre-filter 9 becomes clogged. In addition, a filter exchange window 16 is provided in the back surface of the push hood 1 from the high-performance filer 7 so that the high-performance filter 7 can similarly be removed from the push hood 1 and exchanged if the high-performance filter 7 becomes clogged. In FIG. 4B, the air blowing surface 2 is on the upper part of the push hood 1, and on the upper side thereof the alignment mechanism 6, the high-performance filter 7, an axial flow fan 8*b*, the pre-filter 9 and the air intake opening 5 are arranged in a linear configuration, and on the bottom side of the push hood are pillars 20 provided at the four corners of the push hood 1 to keep the push hood at a constant height from the ground, and casters 19 are attached to ends of each of these pillars 20. In this case, the thickness of the push hood 1 main body is thicker than in FIG. 4A, but the push hood 1 as a whole is kept compact. As the fan used as the blowing device in this invention, it is possible to appropriately use the centrifugal fan 8*a* or the axial flow fan 8*b*. In addition, it is possible to remove the pillars 20 in FIG. 4B and use the apparatus by placing the apparatus on a work desk. FIG. 4C illustrates the case when the air blowing surface 2 of the apparatus illustrated in FIG. 4A is moved to the bottom side, and the composition of the apparatus illustrated in FIG. 4A is reversed. In FIG. 4D, high-performance filters 7, centrifugal fans 8*a*, pre-filters 9 and air intake openings 5 are arranged linearly in two rows on the top and bottom of a vertically long alignment mechanism 6, using the centrifugal fan 8*a*. There is only one alignment mechanism 6 in FIG. 4D, but it is possible to have a composition with this divided into two or more mechanisms. This apparatus can form a clean zone over a large range without using a large blowing mechanism 8, taking into consideration noise and/or the like. In particular, it would be fine to control the blowing mechanism 8 with one large fan in locations where considerations such as noise and/or the like are not necessary. In addition, the composition of the apparatus in this FIG. 4D can be changed in the horizontal direction and the clean zone can be enlarged in the horizontal direction, and it is possible to compose such in accordance with appropriate applications.

In the present invention, with the blowing mechanism 8 provided separate from the push hood 1 main body, air is caused to flow to the upstream side of the high-performance filter 7 of the push hood 1 through a duct from the blowing device 8 such as a blower, and the duct is connected to the rear surface of the push hood 1. Even when this blowing mechanism 8 and the push hood 1 main body are separate, it is possible to create a clean zone over a wide range using multiple blowing mechanisms 8 and ducts and connecting multiple ducts to a single push hood, and it is possible to compose such in accordance with appropriate applications. In addition, whether the blowing mechanism 8 is provided separate from the push hood 1 main body or the blowing mechanism 8 is housed inside the push hood 1 main body, it is possible to form a wide-range clean zone by arranging multiple push hoods 1 in parallel in the horizontal direction. In this case, the wind speed of the airflow ejected from the multiple push hoods is preferably kept within ±50% of the dispersion of the speed distribution over the multiple push hoods as a whole.

Preferably, a function is provided that can vary the generated wind speed by phase control, inverter control or impressed voltage control of the blowing device 8 such as a blower installed via a duct separate from the apparatus body of the push hood 1 or a fan housed inside the push hood 1. Through this, it is possible to easily ensure the appropriate wind speed when the installation location of the push hood 1 is moved and the distance between push hoods changes. In addition, when the wind speed balance is destroyed due to clogging of the high-performance filter 7 inside the push hood 1, it is possible to easily restore balance to the clean zone by adjusting the wind speed. In addition, it is possible to make the apparatus body of the push hood 1 compact and to provide a movement means such as casters 19 and/or the like on the bottom of the push hood 1. Through this, it is possible to easily move the apparatus, broadening variations of operation of the apparatus such as responding to changes in work layout or movement between work rooms.

Figure 5A:
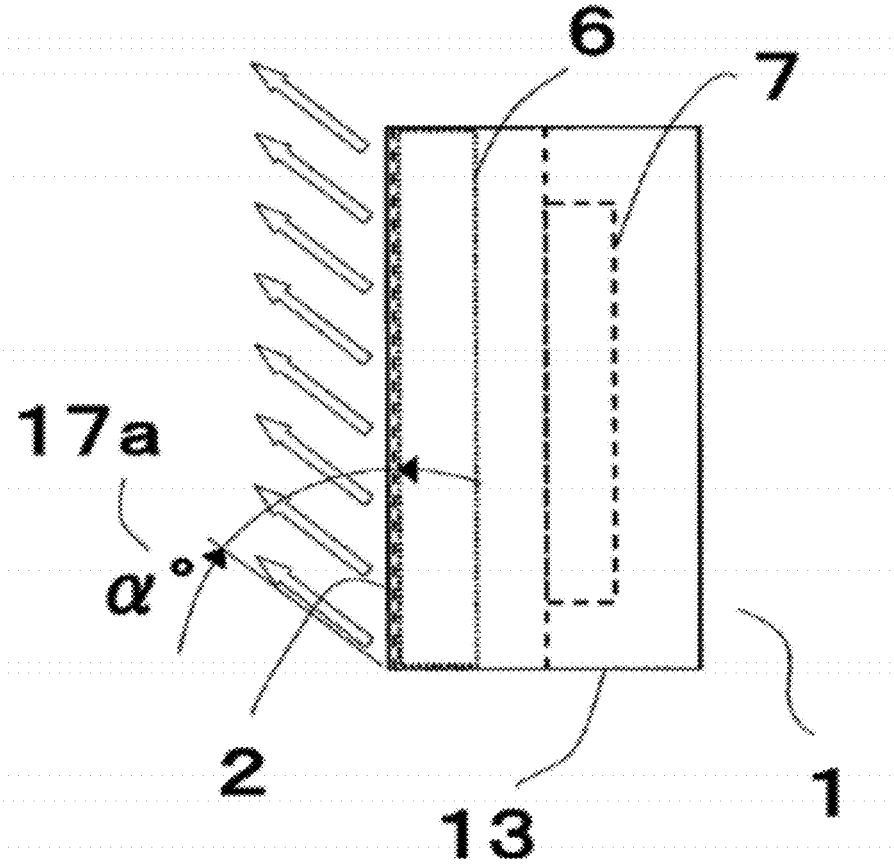
FIG. 5A is a top view showing a representative example of the housing shape of push hoods used in the present invention.
Figure 5B:
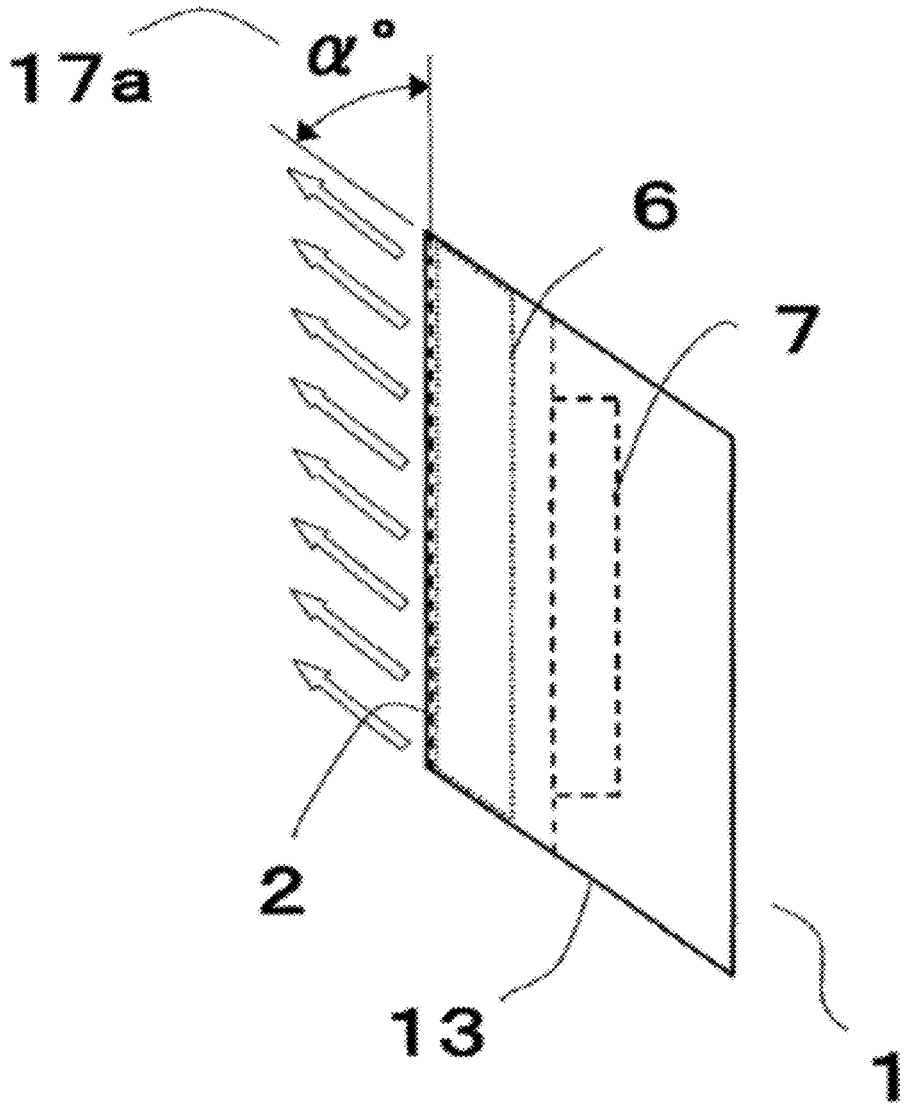
FIG. 5B is a top view showing a representative example of the housing shape of push hoods used in the present invention.
Figure 5C:
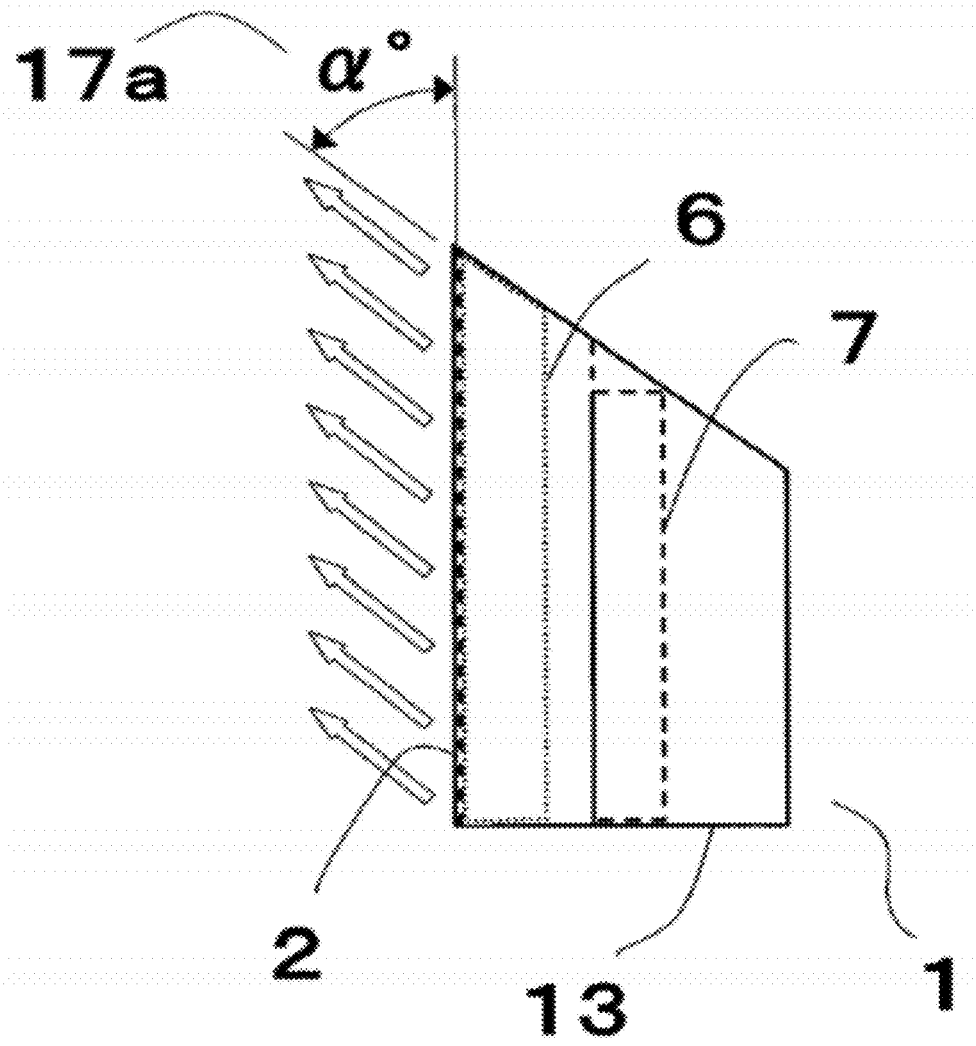
FIG. 5C is a top view showing a representative example of the housing shape of push hoods used in the present invention.
Figure 5D:
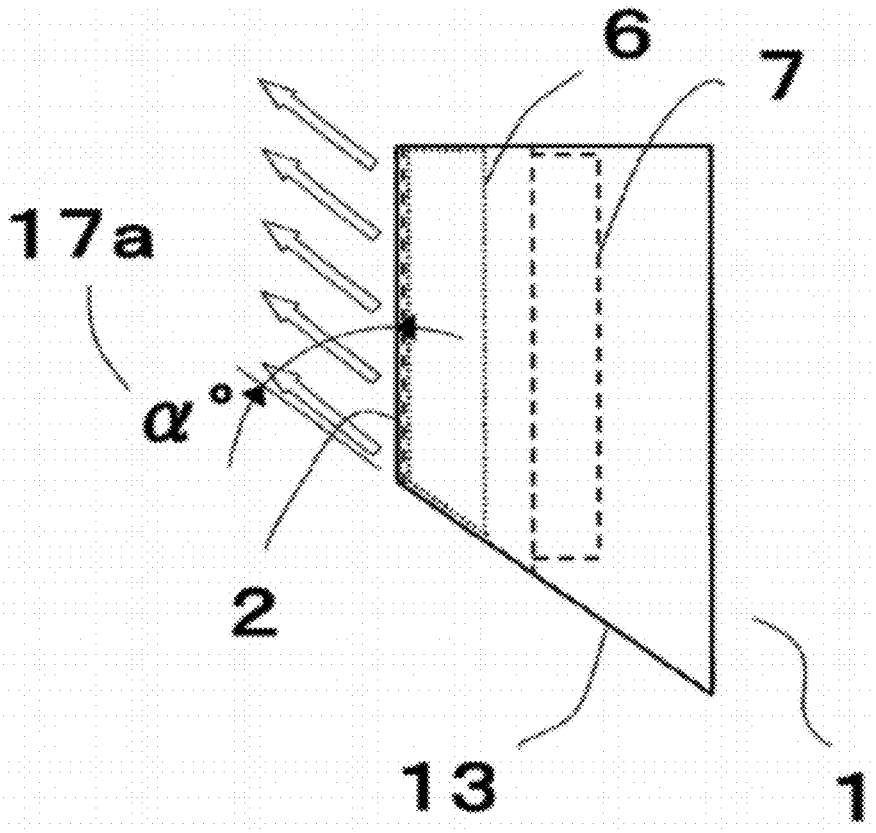
FIG. 5D is a top view showing a representative example of the housing shape of push hoods used in the present invention.

FIGS. 5A, 5B, 5C and 5D are drawings showing the configuration when the push hood 1 of the present invention is viewed from the top surface. The external appearance of this apparatus can be implemented whether as a cube or a rectangular solid, as shown in FIG. 5A, but because this is an apparatus that discharges airflow obliquely with respect to the air blowing surface 2 of the push hood 1, with a rectangular solid or a cube, it is impossible for a worker at the time of installation of the push hood 1 or after installation to distinguish at what angle the apparatus discharges. Consequently, as shown in FIGS. 5B, 5C and 5D, by forming at least one side out of the two sides abutting the boundary and the housing surface having the air blowing surface 2 so as to be parallel to the angle of the uniform airflow discharged in an oblique direction with respect to the air blowing surface 2, it is possible to form an external shape of the push hood 1 so that by simply looking at the external appearance of the push hood 1 it is possible to distinguish at what angle this apparatus discharges airflow. The housing 13 of the push hood 1 has a parallelogram shape in FIG. 5B and a trapezoidal shape in FIGS. 5C and 5D when viewed from the top direction, and through this it is possible to recognize the direction of the airflow generated from the push hood.

Figure 6A:
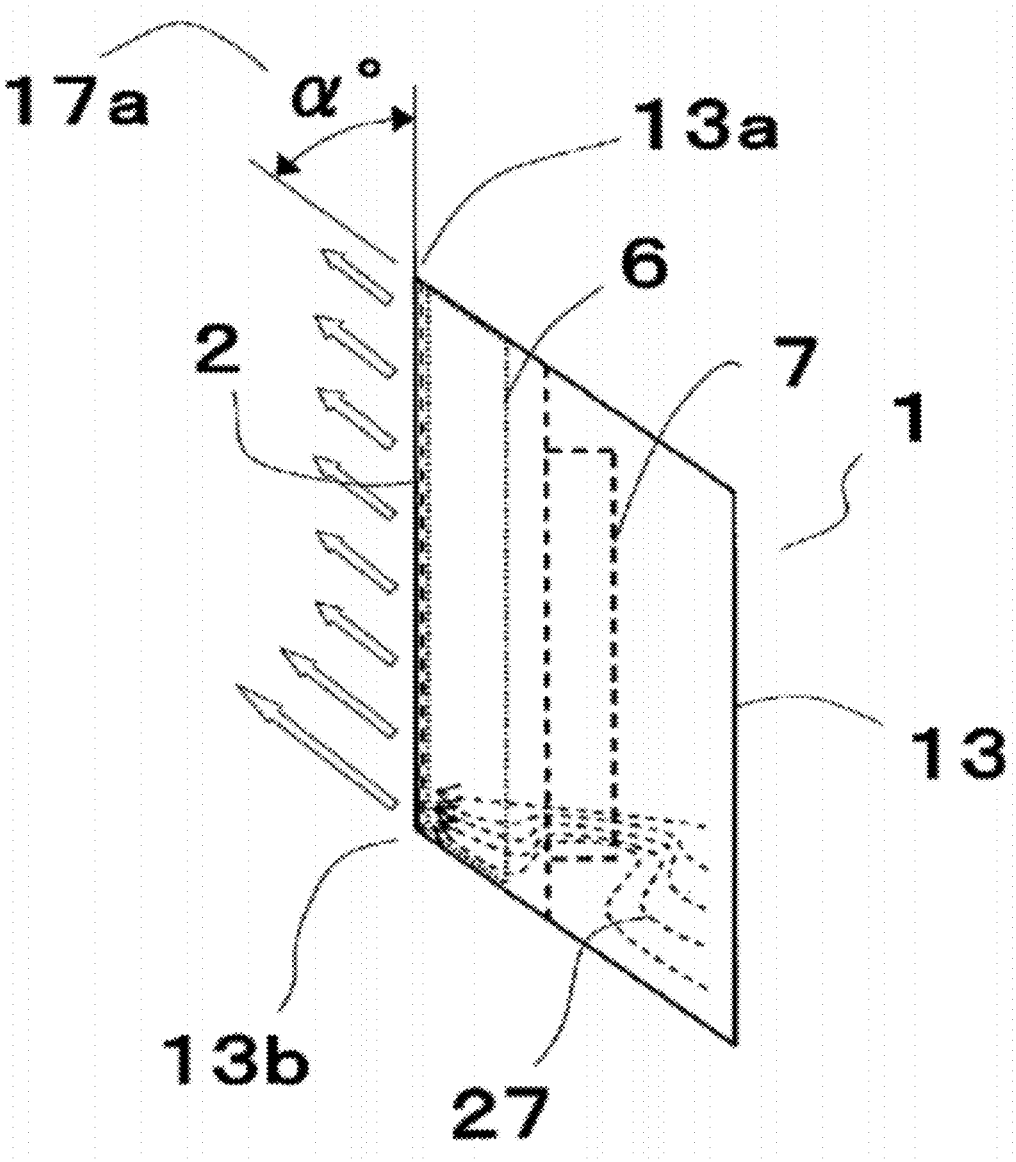
FIG. 6A is a top cutaway view showing a portion of the air flow in push hoods used in the present invention.
Figure 6B:
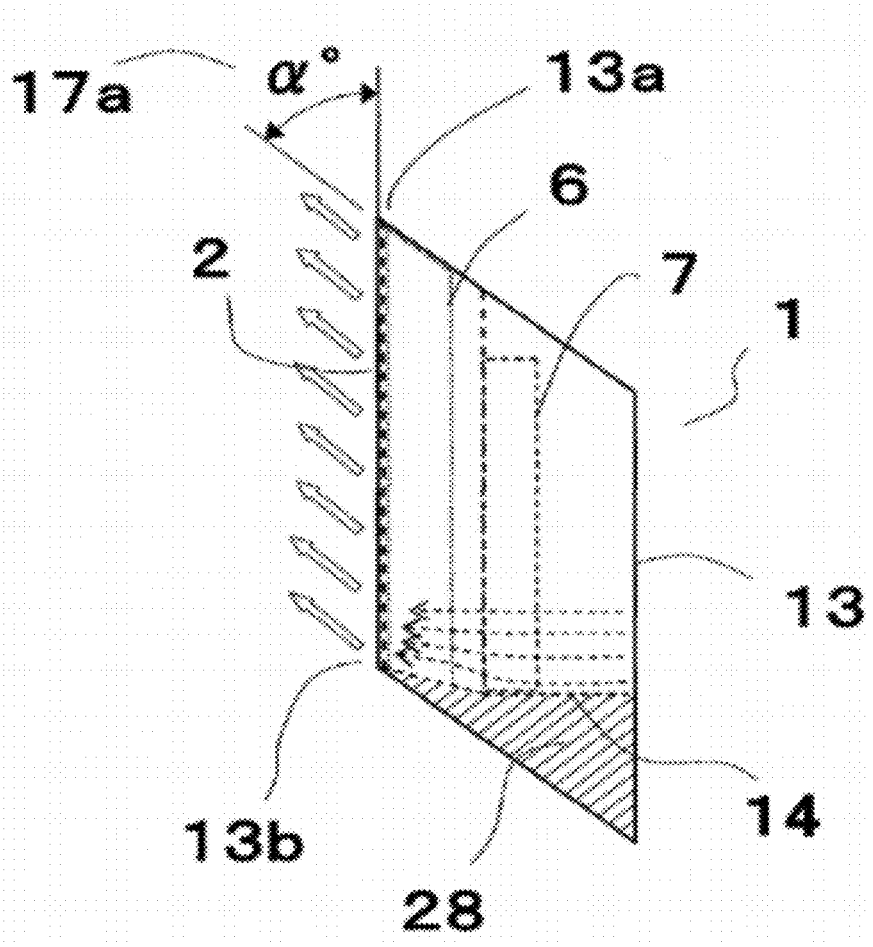
FIG. 6B is a top cutaway view showing a portion of the air flow in push hoods used in the present invention.

FIGS. 6A and 6B are top views showing one example of the push hood 1 having a housing 13 side surface formed parallel to the uniform airflow discharged horizontally and obliquely with respect to the air blowing surface 2. A reference number 13*b* in FIG. 6A is where the housing 13 is formed at an obtuse angle with respect to the air blowing surface 2 and a reference number 13*a* is where conversely an acute angle is formed. Drifts occur at the location indicated by reference number 27 on the 13*b* side, and through this some disturbance is created in the uniform airflow. As shown in FIG. 6B, airflow to the 13*b* side is restricted by installing a shielding plate 14 in the vertical direction from the air blowing surface 2 of the side 13*b* on which the housing 13 forms an obtuse angle with respect to the air blowing surface 2 to the housing on the rear side opposite that, and from the top edge to the bottom edge of the air blowing surface, so that it is possible to cause this drift 27 to not occur.

Figure 7A:
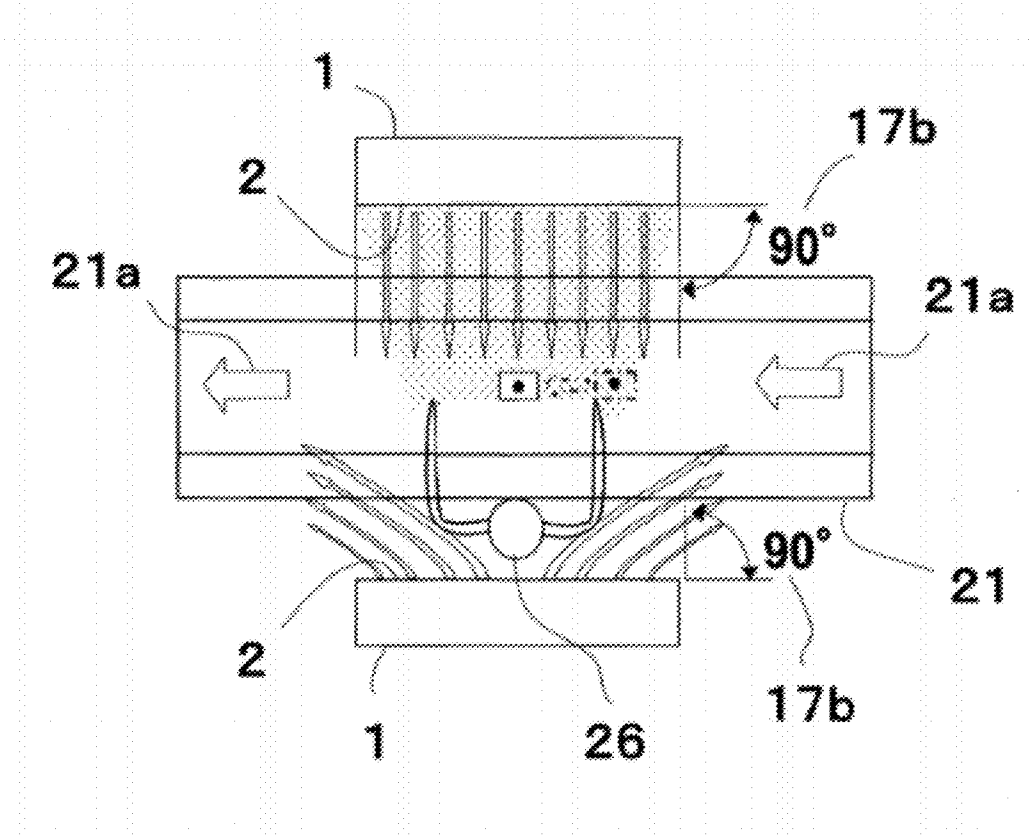
FIG. 7A is a top view showing an installation example of the apparatus of Patent Literature 4, being a conventional local clean zone forming apparatus using a pair of push hoods.

In general, in production locations where a clean zone is necessary, production parts and/or the like exist and in many cases accompany transportation of such or transportation of such including production workers. Until now, it was difficult to form a clean zone 4 without restricting work in such production locations. Even if a clean zone were formed by interposing a production parts conveyor means 21 such as a belt conveyor between a pair of push hoods 1 discharging air in a perpendicular direction with respect to a conventional air blowing surface 2, the worker himself 26 had to enter the air blowing surface 2 of the push hood 1 forming that clean zone 4, and through this the body of the worker himself 26 obstructs the real air blowing surface 2, and even if there is no obstruction, the body of the worker himself 26 is buffeted by the airflow, causing large disturbance in the airflow so that the cleanliness of the clean zone 4 drops. FIG. 7A is a drawing showing an example of a top view when the blowing opening surfaces 2 of the push hoods are perpendicularly opposed.

Figure 7B:
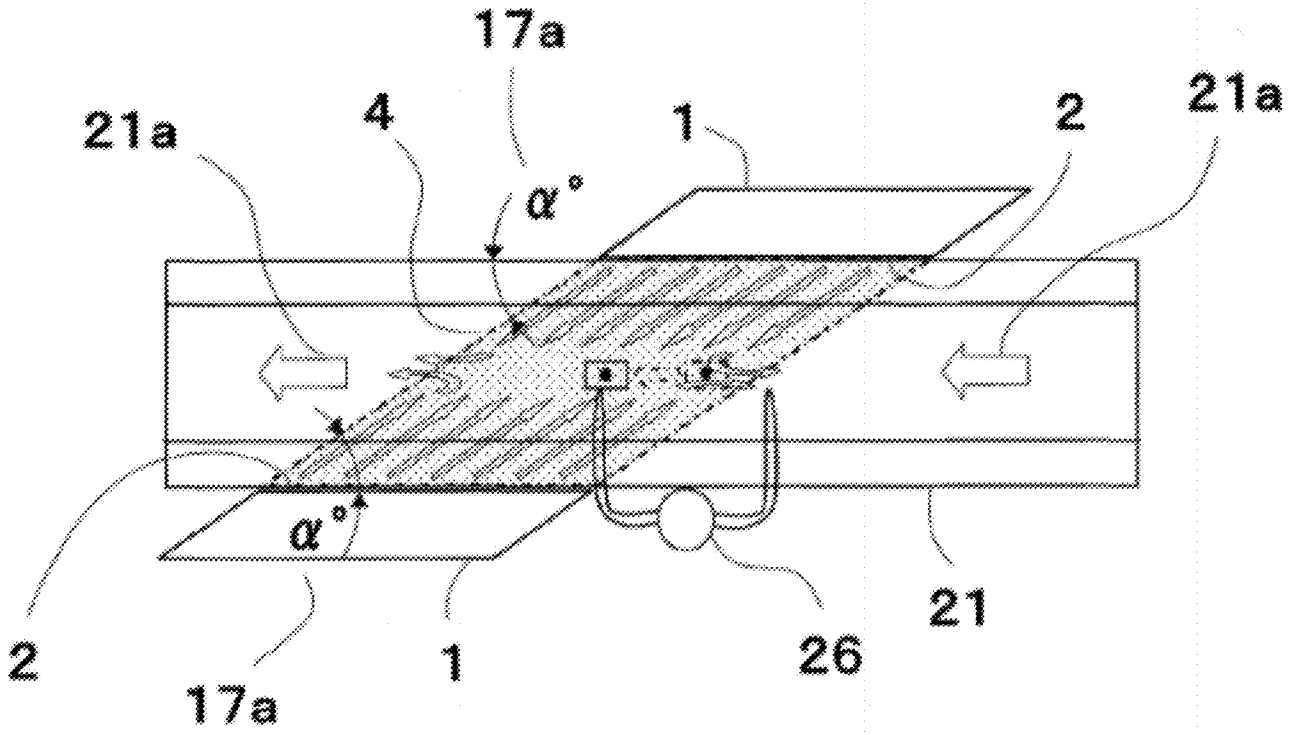
FIG. 7B is a top view showing an installation example of the local clean zone forming apparatus using a pair of push hoods according to the present invention.

FIG. 7B is a drawing showing one example of a top view when the local clean zone forming apparatus of the present invention is arranged interposing a manufacturing parts conveyor means 21 such as a belt conveyor and/or the like. The apparatus of the present invention has a pair of push hoods 1 composed so as to blow uniform airflow at an angle 17*a* in an oblique direction with respect to the air blowing surface 2 arranged with respect to the conveyor means 21 so as to interpose the conveyor means 21 such that the air blowing surface 2 of each are parallel and in a positional relationship such that the centers of the air blowing surfaces 2 are not directly opposite to each other from a direction perpendicular to the conveyor direction 21*a* of the conveyor means 21 so that the uniform airflows of each discharged from the push hoods 1 are opposite each other and collide, and through this, a three-dimensional clean zone 4 is formed that does not have enclosures in the flow direction of the airflow whose base has a parallelogram shape between the air blowing surfaces 2 of the pair of push hoods 1. By using the apparatus of the present invention, it is possible to form the clean zone 4 at an angle 17*a* in an oblique direction, so work can be done with the body of the worker himself 26 not entering the airflow and only from the arm of the worker 26 outward entering the airflow of the clean zone, and consequently it is possible for the worker 26 to do work without large disturbances being created in the airflow of the clean zone 4 thus formed.

Figure 8A:
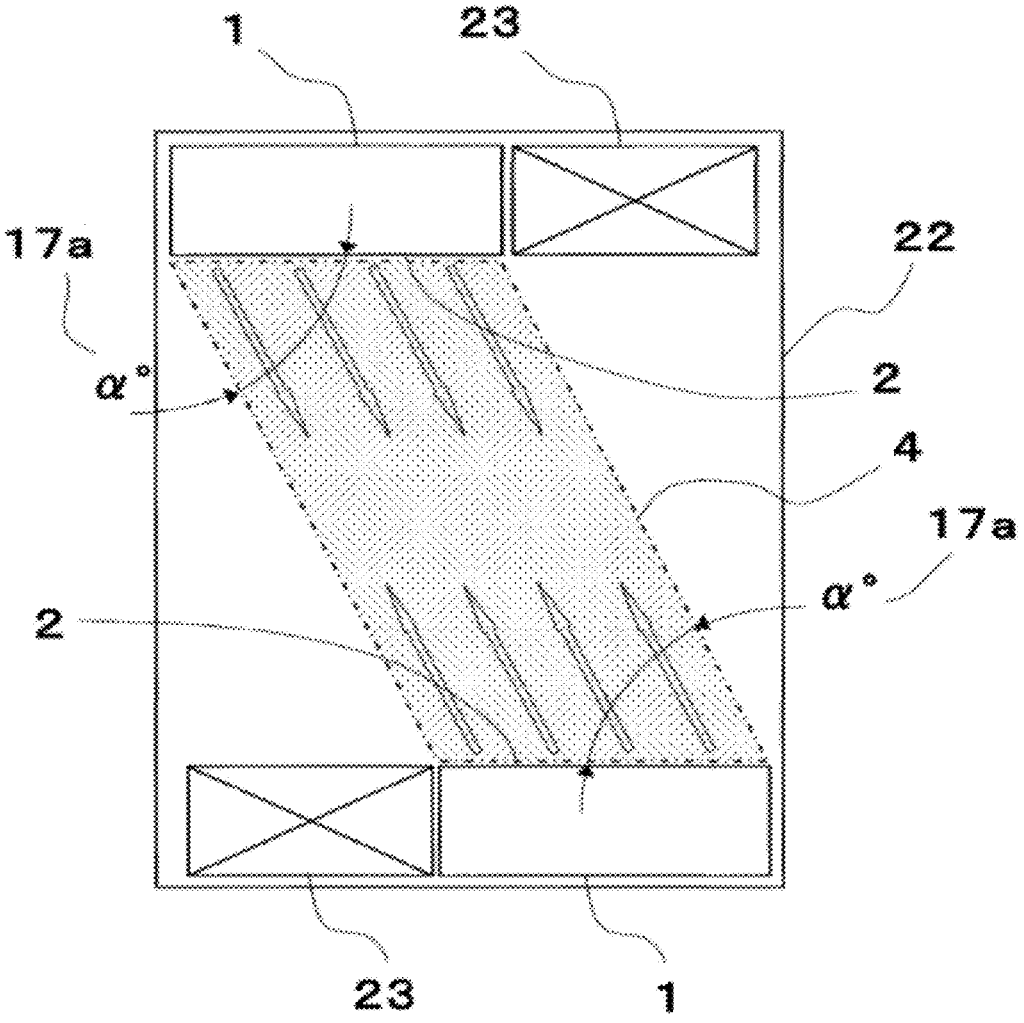
FIG. 8A is a top view showing an installation example of the local clean zone forming apparatus using a pair of push hoods according to the present invention.
Figure 8B:
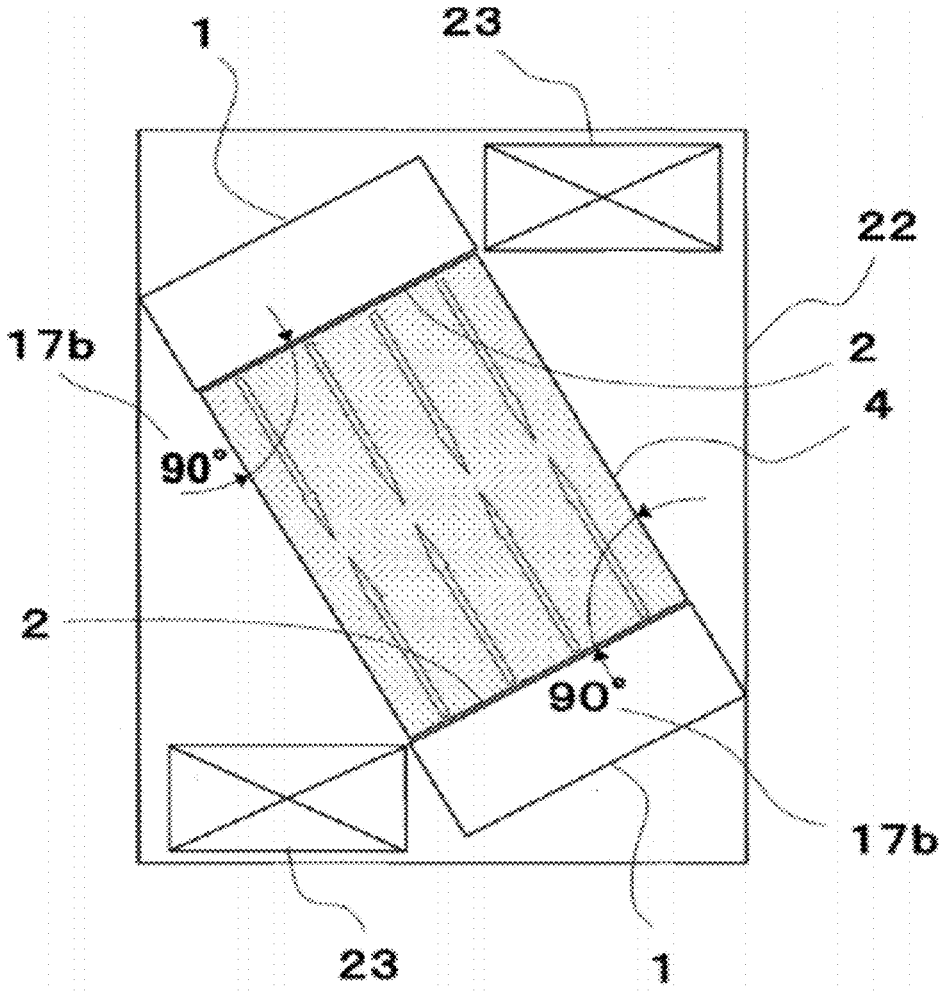
FIG. 8B is a top view showing an installation example of the apparatus of Patent Literature 4, being a conventional local clean zone forming apparatus using a pair of push hoods.

With a conventional pair of push hoods that discharge airflow in a perpendicular direction with respect to the air blowing surfaces 2, when an obstruction 23 that is difficult to move, such as a pillar or manufacturing equipment, exists in the installation area of a narrow apparatus, it was difficult to install the apparatus so that the airflows were directly opposite each other. Even if installation were possible, it was necessary to have the air blowing surfaces 2 of the pair of push hoods directly opposite each other, so unnecessary space was taken in the installation area 22. The present invention can form a clean zone 4 at an angle 17*a* in an oblique direction, and consequently it is possible to install the apparatus to match the structure of the work area 22, avoiding obstructions 23. FIG. 8A is a top view showing a configuration with the local clean zone forming apparatus of the present invention installed in a narrow location. Compared to the directly-opposite approach shown in FIG. 8B, it is possible to efficiently use the work area keeping the installation space to an effective minimum, and it is possible to form the clean zone 4 even in a narrow work area 22 where installation has been impossible until now.

For the push hood used in the present invention, functional conditions such as the size of the airflow blowing surface and the blowing speed, along with the distance between push hoods, can be appropriately selected in accordance with work content and other conditions. As one example, conditions that can be cited include an air blowing surface that is a square or rectangle of side length 300-3000 mm, a blowing speed of 0.1 to 2.0 m/second, and a distance between push hoods of 1-9 m.

PREFERRED EMBODIMENTS

Below, the present invention will be described based on specific examples.

Preferred Embodiment 1

Figure 9A:
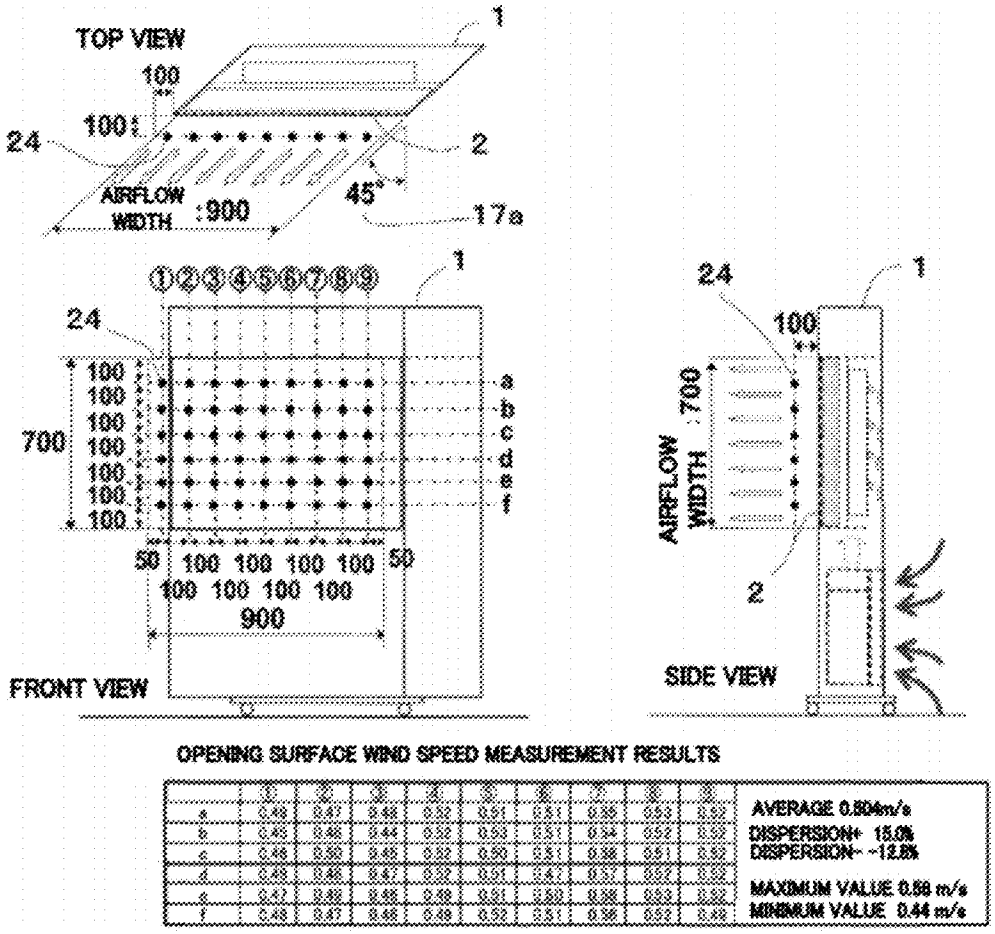
FIG. 9A is an explanatory chart of measurement positions and measurement results in a first experimental example.

A push hood 1 for discharging uniform airflow was created using as sheathing 12 a welded mesh made by overlapping multiple meshes equally in the horizontal and vertical directions so that a 30 mm square lattice was formed of stainless steel sheathing material with $\phi$ 1.0 mm on the air blowing surface 2, with the locations where the sheathing materials of each overlap welded and anchored, this sheathing 12 was disposed on a rectangular air blowing surface 2 measuring 900 mm×700 mm arranged on the top of a push hood 1, an alignment mechanism 6 having virtually the same size an area as the air blowing surface 2 was positioned on the upstream side of that air blowing surface 2, with a HEPA filter 7 further to the upstream side, and anchored to an anchoring frame provided in a housing packing so that air flowing between the alignment mechanism 6 and the HEPA filter 7 does not leak out, and a centrifugal fan was installed on the lower level of the push hood 1 still further to the upstream side. The alignment mechanism 6 was composed of a first honeycomb-shaped parallel porous body 10*a* to the downstream side of the air that is the air blowing surface 2 side, air resistors 11*a*, 11*b* and 11*c* composed of three punching boards, and a second honeycomb-shaped parallel porous body 10*c*. The three punching boards 11*a*, 11*b* and 11*c*, which are air resistors, were positioned with gaps of 10 mm and 20 mm from the respective downstream-side punching boards 11, and three punching boards 11*a*, 11*b* and 11*c* all having the same aperture ratio, being made of aluminum with a thickness t of 1.0 mm, round holes with a hole diameter of ϕ 1.0 mm, a pitch of 2.0 mm, a 60° hound's-tooth and a hole opening ratio of 23% were used. In addition, for the honeycomb-shaped parallel porous bodies 10 used, ones made of aluminum that is 0.001 mm thick with the porous section being a regular hexagon ⅛ inch in size were used for both the first and second honeycomb-shaped parallel porous bodies 10*a* and 10*c*, and ones with a thickness of the honeycomb-shaped parallel porous body 11 as a whole of 8 mm with the porous body in a state inclined at an angle α 45° in a horizontal oblique direction were used. The composition of this push hood is the push hood with the alignment mechanism shown in FIG. 3D housed inside the push hood shown in FIG. 4A. Using the above-described push hood 1, the wind speed of the air blowing surface 2 was measured at measurement points 24 in 54 locations. The wind speed measurement positions and results for the air blowing surface 2 are shown in FIG. 9A.

The dispersion of wind speed distribution with respect to the average wind speed when the air blowing surface wind speed was around 0.5 m/s was a maximum 15.0%. From the above results, it can be seen that this apparatus is such that there is an extremely small dispersion in wind speed distribution far below the 50% that is the condition for uniform airflow deemed necessary with the present invention. Even when there was only one honeycomb-shaped parallel porous body 10*a* on the air blowing surface side of the alignment mechanism and only one punching board as the air resistor 11*a* on the upstream side thereof, results of 50% or less were obtained.

Preferred Embodiment 2

Next, an example of measuring the cleanliness of the air when the local clean zone forming apparatus of the first preferred embodiment was used will be described.

Unlike the cleanliness classes used with clean rooms used here, the following definitions are used.

When $C_o$ is the dust particle concentration (0.1 μm/0.01 cf) near the fan intake opening (room air) and $C_p$ is the dust particle concentration (0.1 μm/0.01 cf) of the push air, the cleanliness can be found from the following equation.

$$\text{Cleanliness (\%)}=100\times(C_o-C_p)/C_o$$

Following the present invention, two of the same push hoods as in the first preferred embodiment were used, these were positioned as shown in FIG. 1 so that the two airflows were opposing each other, and the cleanliness was measured at the same blowing speed (0.5 m/second). The distance in the vertical direction of the air blowing surfaces 2 of the push hood 1 was set at 1500 mm and the distance between the two push hoods was set at 2100 mm. Cleanliness measurement points 25 were measured in a total of nine locations positioned 250 mm in the vertical direction from the air blowing surfaces of the push hoods 1 and at the center position between the push hoods. From the test results, high cleanliness was exhibited at all measurement points, and it was clear that virtually all regions between the push hoods were clean regions.

Figure 9B:
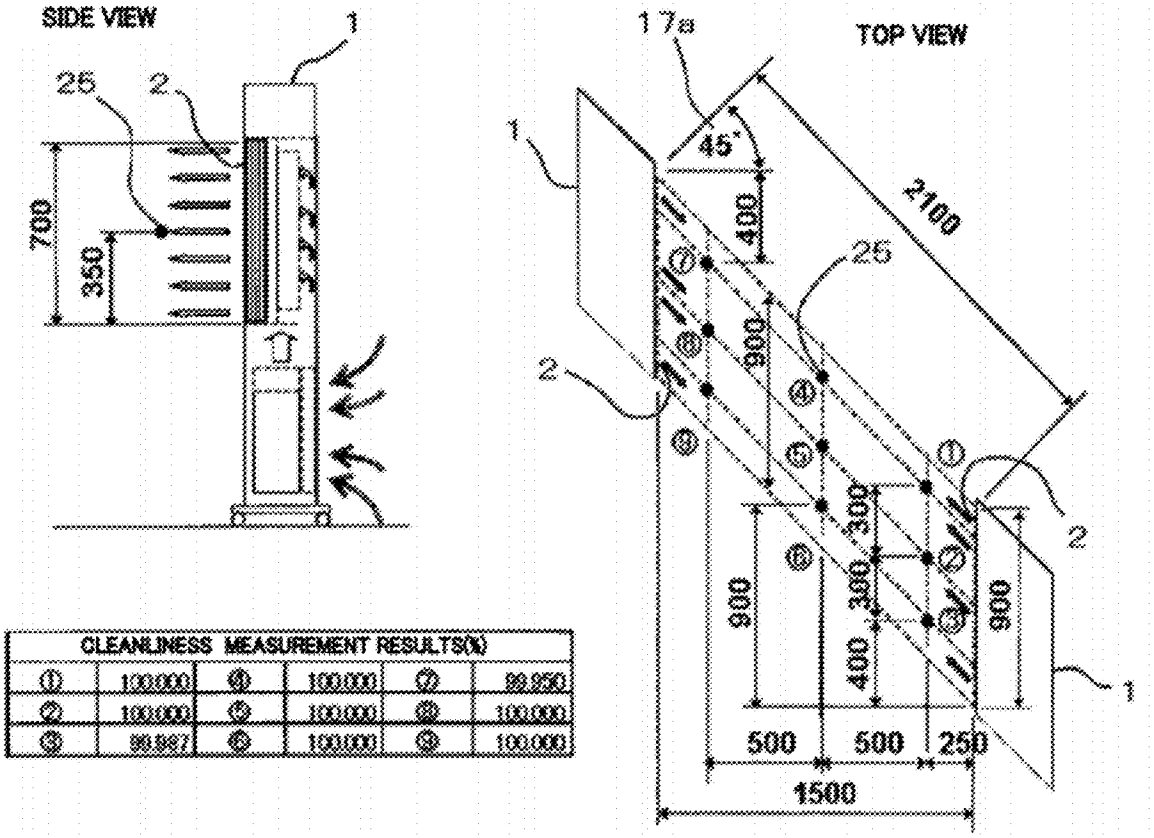
FIG. 9B is an explanatory chart of measurement positions and measurement results in a second experimental example.

The cleanliness measurement positions and measurement results in the second preferred embodiment are shown in FIG. 9B.

INDUSTRIAL APPLICABILITY

The local clean zone forming apparatus of the present invention can be effectively utilized in fields necessitating clean zones in which conventional clean benches, clean booths or clean rooms have been used.

DESCRIPTION OF REFERENCE NUMERALS

1 Push hood
2 Air blowing surface
3 Uniform airflow space
3*a* Expanded uniform airflow space
4 Clean zone
5 Air intake surface
6 Alignment mechanism
6*a* Alignment mechanism (air blowing surface side)
7 High-performance filter (HEPA filter, ULPA filter)
8 Blowing mechanism
8*a* Centrifugal fan
8*b* Axial flow fan
9 Medium-performance filter (pre-filter)
10 Honeycomb-shaped parallel porous body
10*a* First honeycomb-shaped parallel porous body (oblique)
10*b* Second honeycomb-shaped parallel porous body (perpendicular)
10*c* Second honeycomb-shaped parallel porous body (oblique)
11 Air resistor
11*a* First air resistor
11*b* Second air resistor
11*c* Third air resistor
12 Sheathing
13 Housing
13*a* Housing (acute angle part)
13*b* Housing (obtuse angle part)
14 Shielding plate
16 Filter exchange window
17 Air blowing angle
17*a* Air blowing angle (oblique)
17*b* Air blowing angle (perpendicular)
18 Blowing control unit
19 Casters
20 Pillar
21 Manufactured part conveyor means (belt conveyor)
21*a* Part conveyor direction
22 Installation area
23 Obstruction (pillar, equipment)
24 Wind speed measurement point
25 Cleanliness measurement point
26 Worker
27 Drift
28 Non-airflow part

The invention claimed is:

1. A local clean zone forming apparatus comprising a pair of push hoods each having an air blowing surface and having an alignment mechanism for forming uniform airflow installed inside the air blowing surface are disposed so that the uniform airflows discharged from the push hoods are opposite to and collide with each other in a positional relationship in which the air blowing surfaces are parallel to each other and the centers of the air blowing surfaces are not directly opposite each other, and the uniform airflows are obliquely discharged at an angle with respect to the air blowing surfaces to form a clean zone between air blowing surfaces, wherein one of the pair of the push hoods is configured to obliquely discharge an airflow at a predetermined angle with respect to the air blowing surface of that push hood, the other of the pair of the push hoods is configured to obliquely discharge an airflow at the same angle with respect to the air blowing surface of the other push hood as the predetermined angle, the pair of the push hoods discharges the uniform air flows through the air blowing surface to form the clean zone having a non-rectangular parallelogram-shaped base between the air blowing surfaces of the push hoods when the pair of the push hoods is viewed from above, wherein work can be done with a body of a worker not entering the airflow and only from an arm of the worker entering the clean zone thereby minimizing disturbance in the airflow of the clean zone, and a transport path for conveyor means is placed between the push hoods such that the airflow intersects the transport path at the oblique angle.

2. The local clean zone forming apparatus according to claim 1, wherein the transport path is places to be parallel with the air blowing surfaces of the pair of the push hoods.

3. The local clean zone forming apparatus according to claim 2, wherein the transport path transports manufacturing parts on a production line.

4. The local clean zone forming apparatus according to claim 1, wherein the transport path transports manufacturing parts on a production line.

5. The local clean zone forming apparatus according to claim 1, wherein the alignment mechanism is composed of at least one air resistor positioned on an upstream side and at least one honeycomb-shaped parallel porous body positioned on a downstream side, the honeycomb-shaped parallel porous body is composed of multiple unit porous bodies arranged in parallel, and each unit porous body has a hole depth greater than a hole diameter, and is positioned at an angle in an oblique direction with respect to the air blowing surface, and thereby the uniform airflows are obliquely discharged at the angle with respect to the air blowing surface.

6. The local clean zone forming apparatus according to claim 5, wherein a porous section of the honeycomb-shaped parallel porous body of the alignment mechanism is positioned at the angle in the oblique direction with respect to the air blowing surface.

7. The local clean zone forming apparatus according to claim 6, wherein when the push hoods are viewed from a top surface direction, at least one of the two side surfaces abutting a boundary of a housing surface having the air blowing surface of a housing forming the external shape of the push hoods is parallel to the angle of the uniform airflow discharged in the oblique direction with respect to the air blowing surface.

8. The local clean zone forming apparatus according to claim 7, wherein when the push hoods are viewed from the top surface direction, in a push hood in which the angle formed by the surface having the air blowing surface of the housing forming the external shape of the push hood and the side surface abutting the boundary is an obtuse angle and that side surface is parallel to the angle of the uniform airflow discharged in a horizontal oblique direction with respect to the air blowing surface, within the housing and in a vicinity of the side surface having the obtuse angle with the surface having the air blowing surface, a shielding plate is disposed in a vertical direction from a top edge to a bottom edge of the air blowing surface and from the air blowing surface to a backside of the housing opposite to the air blowing surface.

9. The local clean zone forming apparatus according to claim 5, wherein each unit porous body has the hole diameter of 1 to 10 mm, and a ratio of the hole depth to the hole diameter of each unit porous body is 1:1.2 to 1:5.

10. The local clean zone forming apparatus according to claim 1, wherein when the push hoods are viewed from a top surface direction, at least one of the two side surfaces abutting a boundary of a housing surface having the air blowing surface of a housing forming the external shape of the push hoods is parallel to the angle of the uniform airflow discharged in the oblique direction with respect to the air blowing surface.

11. The local clean zone forming apparatus according to claim 10, wherein when the push hoods are viewed from the top surface direction, in a push hood in which the angle formed by the surface having the air blowing surface of the housing forming the external shape of the push hood and the side surface abutting the boundary is an obtuse angle and that side surface is parallel to the angle of the uniform airflow discharged in a horizontal oblique direction with respect to the air blowing surface, within the housing and in a vicinity of the side surface having the obtuse angle with the surface having the air blowing surface, a shielding plate is disposed in a vertical direction from a top edge to a bottom edge of the air blowing surface and from the air blowing surface to a backside of the housing opposite to the air blowing surface.

12. The local clean zone forming apparatus according to claim 1, wherein all boundary surfaces of the clean zone parallel to the airflow direction of the clean zone formed between the air blowing surfaces of the pair of push hoods are in an open state.

13. The local clean zone forming apparatus according to claim 1, wherein the angle of the uniform airflows obliquely discharged with respect to the air blowing surfaces is 30° to 85°.

* * * * *